US007500634B2

(12) United States Patent
Benvenuti et al.

(10) Patent No.: US 7,500,634 B2
(45) **Date of Patent: *Mar. 10, 2009**

(54) UNWINDER DEVICE FOR REELS OF WEB-LIKE MATERIAL WITH TEMPORARY ACCUMULATOR MEMBERS FOR THE MATERIAL UNWOUND IN THE PHASE OF REEL SUBSTITUTION AND RELATIVE METHOD

(75) Inventors: Angelo Benvenuti, Lucca (IT); Roberto Morelli, Lucca (IT); Romano Maddaleni, Pisa (IT)

(73) Assignee: Fabio Perini S.p.A., Lucca (IT)

( * ) Notice: Subject to any disclaimer, the term of this patent is extended or adjusted under 35 U.S.C. 154(b) by 318 days.

This patent is subject to a terminal disclaimer.

(21) Appl. No.: 10/548,543

(22) PCT Filed: Feb. 27, 2004

(86) PCT No.: PCT/IT2004/000091

§ 371 (c)(1),
(2), (4) Date: Sep. 13, 2005

(87) PCT Pub. No.: WO2004/080869

PCT Pub. Date: Sep. 23, 2004

(65) Prior Publication Data

US 2006/0169826 A1 Aug. 3, 2006

(30) Foreign Application Priority Data

Mar. 13, 2003 (IT) ..... FI2003A0065

(51) Int. Cl.
*B65H 19/14* (2006.01)
*B65H 19/18* (2006.01)

(52) U.S. Cl. ..... 242/552; 242/555.3

(58) Field of Classification Search ..... 242/551, 242/552, 554, 554.2, 555, 555.1, 555.3, 556, 242/558, 559, 555.5, 555.6, 555.7
See application file for complete search history.

(56) References Cited

U.S. PATENT DOCUMENTS

| | | | | |
|---|---|---|---|---|
| 3,989,576 | A | 11/1976 | Collin et al. | |
| 4,695,007 | A | 9/1987 | Muto et al. | |
| 5,518,202 | A | 5/1996 | Focke et al. | |
| 5,730,389 | A * | 3/1998 | Biagiotti | 242/556.1 |
| 5,906,333 | A | 5/1999 | Fortuna et al. | |
| 6,030,496 | A | 2/2000 | Baggot et al. | |

(Continued)

FOREIGN PATENT DOCUMENTS

| | | |
|---|---|---|
| DE | 1 233 686 | 2/1967 |

(Continued)

*Primary Examiner*—Peter M. Cuomo
*Assistant Examiner*—William E Dondero
(74) *Attorney, Agent, or Firm*—Breiner & Breiner, LLC

(57) ABSTRACT

The unwinder device comprises: unwinding members for simultaneously unwinding a first reel (B1) and a second reel (B2), a splicing device (151) for splicing together a first web-like material (N1) coming from said first reel (B1) and a second web-like material (N2) coming from said second reel (B2), an accumulator member (24, 200) for accumulating web-like material (N2) supplied from said second reel (B2) before splicing to the web-like material (N1) supplied from said first reel (B1).

30 Claims, 26 Drawing Sheets

U.S. PATENT DOCUMENTS

| | | | |
|---|---|---|---|
| 2003/0173450 | A1 | 9/2003 | Suzuki et al. |

FOREIGN PATENT DOCUMENTS

| | | | | |
|---|---|---|---|---|
| DE | 198 18 384 | A1 | | 10/1999 |
| DE | 100 02 686 | A1 | | 8/2001 |
| EP | 0 872 440 | A2 | | 10/1998 |
| EP | 1 136 406 | A2 | | 9/2001 |
| EP | 1 162 164 | A1 | | 12/2001 |
| EP | 1 270 470 | A2 | | 1/2003 |
| GB | 2135283 | A | * | 8/1984 |
| WO | WO 95/34497 | A1 | | 12/1995 |
| WO | WO 98/46509 | | | 10/1998 |
| WO | WO 00/56644 | A1 | | 9/2000 |

* cited by examiner

II
II
7
L
43
45
137
139
131
53
57
55
59
73
141
61
65
89
93
B-B
79
A-A
101
99
51
173
175
171
181
177
179
151
M1
161
153
159
24
23
26
9
19=21
15
11
10
12
B1
49
110
115
117
125
114
112
112A
60
111
69
113
116
119
123
121
B0
135
133
41
F131
F133

7
43
55
59
73
73
171
181
179
151
161
N1
153
24
23
26
61
175
177
N1
159
19=21
65
99
89
93
51
101
137
139
B-B
79
A-A
B-B
93
A-A
B1
101
49
141
89
99
65
15
9
15
11
10
45
f131
110
115
117
60
111
113
116
12
41
114
112
125
73
69
73
119
123
121
135
133
131
57
53

59
55
43
151
N1
161
N1
73
141
171
181
179
61
159
N2
24
23
26
9
99
51
N1
175
N2
137
B1
B-B
101
A-A
19=21
15
10
11
139
B2
101
65
45
99
115
125
117
113
116
15
10
60
5
73
119
131
57
53
114
112
110
111
41
123
135
121
41
133

43
55
59
61
141
N1
171
175
51
99
153
N2
24
23
9
161
137
B1
139
B2
93
89
101
49
45
79
19=21
15
10
11
115
125
117
113
116
60
73
41
114
112
110
111
119
123
121
131
53
57
133
135

IV 17A
33
31
27=29
25
19
35
24
23
26
19
15
10
11
B1
15
10
9
12
IV

UNWINDER DEVICE FOR REELS OF WEB-LIKE MATERIAL WITH TEMPORARY ACCUMULATOR MEMBERS FOR THE MATERIAL UNWOUND IN THE PHASE OF REEL SUBSTITUTION AND RELATIVE METHOD

TECHNICAL FIELD

This invention concerns an unwinder device for unwinding reels of web-like material wound around a central spindle for supplying web-like material to a converting or processing line.

The invention also concerns a method for unwinding reels of web-like material and for feeding the unwound material to a converting or processing line.

STATE OF THE ART

In many industrial applications, there is a requirement to feed a production line with a web-like material that is unwound from a reel or multiple reels in parallel. Typically, the feeding of web-like material is requested in the paper industry. For example, for the production of paper serviettes, rolls of toilet paper, kitchen rolls or the like, converting lines are provided in which a web-like material is supplied from a reel of large diameter and very long axial length to a series of stations downstream, at the end of which the finished product is obtained. In the case of rolls of toilet paper and similar products, the web-like material is supplied from one or more large-diameter mother reels and wound onto rolls or logs of smaller diameter, which are successively cut orthogonally to their own axis to obtain the finished rolls. In certain cases, the web-like material supplied by the large-diameter reel or reels is cut longitudinally to form in parallel a number of rolls of minor height, i.e. of minor axial length.

In the case of serviette production, web-like material is fed from one or more large-diameter reels that, cut in longitudinal strips if necessary, is folded longitudinally, cut, and folded transversely.

The production of rolls, serviettes or other articles is performed at high speed and in a continuous manner, requiring the periodic substitution of the large-diameter reels as they run out. In many case, it is necessary to stop the production line or at least drastically reduce the speed thereof, to allow the empty reels to be replaced by new reels. This operation reduces the overall productivity of the line, with evident economic damage. There is therefore a need to provide unwinder devices that permit a rapid and reliable substitution of empty reels with new reels. These devices must also handle the splicing, that is the joining, of the-web-like materials coming from consecutive reels. The purpose of this is to obtain a substantial continuity in the supply of the web-like material to the downstream production line. The web-like portion containing the splice is normally discarded. When the line produces rolls, the splicing portion will end up on a roll or log that is subsequently discarded and recycled.

In WO-A-9534497 an unwinder device is describes that permits the automatic, rapid and reliable splicing of two web-like materials coming respectively from an empty reel and a new reel in substitution. On this device, a shuttle or carriage is provided that travels between a loading station and an unwinding station, each time to transfer a reel from the loading station to the unwinding station and to remove the empty tubular core from the unwinding zone to an unloading zone. Means are provided on the shuttle for the preparation and restraint of the free leading edge of web-like material wound on the reel loaded on the shuttle itself. In the unwinding station, a cutting member and a retainer member are provided that serve to produce a free tail edge on the web-like material supplied from the previous supplying reel and to retain this free edge for subsequently producing the splicing with the free leading edge of web-like material on the reel inserted in the unwinding station by the shuttle.

To perform the substitution of the empty reel with a new reel it is therefore necessary to stop the supply of web-like material, even though the splicing operation is rendered particularly rapid by the innovative arrangement of the cutting and splicing means described in this publication.

In WO-A-0056644 another unwinder device is described that can use the same type of mechanism for the splicing two web-like materials coming from two successive reels. In this case as well, the substitution of the reels takes place after halting the feeding of web-like material to the downstream production line. Although it is possible to provide a certain accumulation of web-like material from the unwinder to the production line, via a festoon accumulator for example, this is not always suitable due to the characteristics of the web-like material, which may not be particularly resistant to traction, or due to the high speed of the production line, which would require an excessively large accumulator. In addition, the tortuous path defined by the festoon can cause the detachment of fibres from the web-like material, especially when this is made of tissue paper, with the consequent production of dust and a diminishment in the characteristics of the finished product.

In EP-A-1136406 an unwinder with a shuttle that transfers the reels from one or the other of two loading and unloading positions to an intermediate unwinding position is described. The shuttle has a motorized tailstock for unwinding the reel. The substitution of an empty reel with a new reel requires halting the feed.

Studies have been made for the realization of an unwinder that permits the automatic and continuous substitution of the reels, i.e. without halting the supply of the web-like material to the converting or production line downstream of the unwinder. Examples of unwinders that should operate continuously are described in U.S. Pat. No. 5,906,333, U.S. Pat. No. 6,030,496, EP-A-1,270,470, EP-A-0872440 and WO-A-9846509. In these publications, an unwinder is described in which the reel is supported by a pair of oscillating arms in the supply phase. When the reel is nearly empty, the arms deposit it on a cradle formed by two rollers, one of which is motorized, to continue the rotation of the reel and thus the supply of the web-like material. Successively, the pair of oscillating arms pick up a new reel from a shuttle and starts to unwind the leading edge with the aid of a suction belt. The free leading edge of the new reel is made to fall on top of the web-like material being unwound on the first reel, at this point nearly empty. The contact between the two web-like materials should provoke the transport of the free leading edge of web-like material wound around the second reel and its feeding together with first web-like material until a nip formed by two embossing or laminating cylinders is reached, which should splice the two webs together.

The operation of this unwinder device is extremely insecure as precisely in the initial, and most critical, phase of feeding the new web-like material its transport is entrusted to the simple contact between two extremely light materials. Nothing guarantees that the web-like material coming from the new reel effectively follows the path defined by the first web-like material coming from-the reel that is running out. In addition, since the splicing of the two layers must occur when they have the same feed speeds, it is, necessary to arrange the cylinders that perform the splicing at a considerable distance from the reel unwinding zone. In fact, the amount of web-like material unwound by the new reel in the acceleration phase until the speed reached is the same as that of the material coming from the first reel is considerable. The distance between the reel and the splicing cylinders must be at least equal to the length of the web-like material unwound in this phase of acceleration. The position of the cylinders that perform the splicing of the two web-like materials must be situated at the point in which the head of the second web-like material finds itself at the moment of splicing and not further back, because otherwise the head of the web-like material will remain free and will accidentally wrap itself around one of the rollers of the production line with the consequent jamming of the entire production line.

OBJECTS AND SUMMARY OF THE INVENTION

The object of this invention is to provide of an unwinder device that permits the substitution of an empty reel with a new reel in a reliable manner whilst at speed, i.e. by making the new reel rotate at an opportune peripheral speed, typically equal to that of the reel that is running out, before performing the splicing of the two web-like materials.

This, and other objects and advantages, which will appear clear to those skilled in the art from reading the text that follows, are essentially achieved with an unwinder device including:

- unwinding members for simultaneously unwinding a first reel and a second reel,
- a splicing device for splicing together a first web-like material coming from said first reel and a second web-like material coming from said second reel,
- an accumulator member for accumulating web-like material supplied by said second reel before splicing with the web-like material supplied by said first reel.

With a device of this type, it is possible to effectively keep under control the free leading edge and the first portion of web-like material unwound from a new reel destined to substitute the reel that is running out. The accumulation is carried out until the new reel reaches a suitable rotational speed, which when reached allows the splice between the two web-like materials to be made.

It is no longer necessary, as in known devices, to abandon the free edge of material coming from the second reel on the material being supplied from the reel that is running out. The possibility of accumulating the web-like material during the acceleration phase of the second reel also permits the splicing device to be situated very close to the position of the reels.

In addition, by arranging the temporary accumulator member downstream of the zone in which the splice starts between the web-like materials coming from the two different reels, it is possible to place the splicing device close to the unwinder, with consequent advantages regarding the size of the line and reliability in controlling the material in transit.

In a practical and advantageous embodiment, the accumulator member is reversible, i.e. realized in a manner such that it can pass back the accumulated web-like material, after the first and the second web-like materials have been spliced together. In this way, the initial portion, unwound from the second reel and temporarily accumulated by the accumulator member is carried away to the transformation line and retrieved as dross at the end of the line, for example from the roll or log containing the splice of the two web-like materials.

In a possible embodiment of the invention, the splicing member and the unwinding members are controlled in a manner such that the splicing member splices together the first and the second web-like materials when the first and the second reel rotate at substantially the same peripheral speed.

In practice, the accumulator member can include at least one motorized roll to which the free leading edge of web-like material wound on the new reel is fixed, so that it can wind around said motorized roll when the new reel is made to rotate and before this web-like material is spliced to the web-like material supplied from the reel that is running out.

In a modified embodiment of the invention, the accumulator member includes a suction chamber.

In accordance with another aspect, an object of this invention is to provide a method of unwinding a web-like material that permits correct control of the web-like material and rapid substitution of empty reels with new reels without interrupting the feeding of material to a production line.

In accordance with the invention, this objects is achieved by a method comprising the following phases:

- unwinding a first web-like material from a first reel and supply said web-like material to a production line,
- making a second reel rotate and start to unwind a second web-like material from it,
- accumulating said second web-like material in an accumulator member,
- splicing said second web-like material to said first web-like material and supply said second web-like material to said production line.

Further advantageous characteristics and embodiment of the method and the device in accordance with the invention are indicated in the attached dependent claims.

In the following, the invention will be illustrated with application to an automatic unwinder of new conception, which presents a number of advantages and innovations with respect to known unwinders. Nevertheless, it must be understood that the invention could also be applied to known types of unwinders, for example of the type described in U.S. Pat. No. 5,906,333, U.S. Pat. No. 6,030,496, EP-A-1,270,470, EP-A-0872440, WO-A-9846509 or to any unwinder device where it is possible to make two reels rotate simultaneously to perform the splice. The invention can also be applied to unwinders where in regular running, that is after the splice between the web-like materials, the unwinding is effected via traction.

BRIEF DESCRIPTION OF DRAWINGS

The invention will be better understood following the description and the enclosed drawings, which illustrates a practical, non-limitative embodiment of the invention. In particular, in the drawings.

DETAILED DESCRIPTION OF THE PREFERRED EMBODIMENTS OF THE INVENTION

Figure 1A:
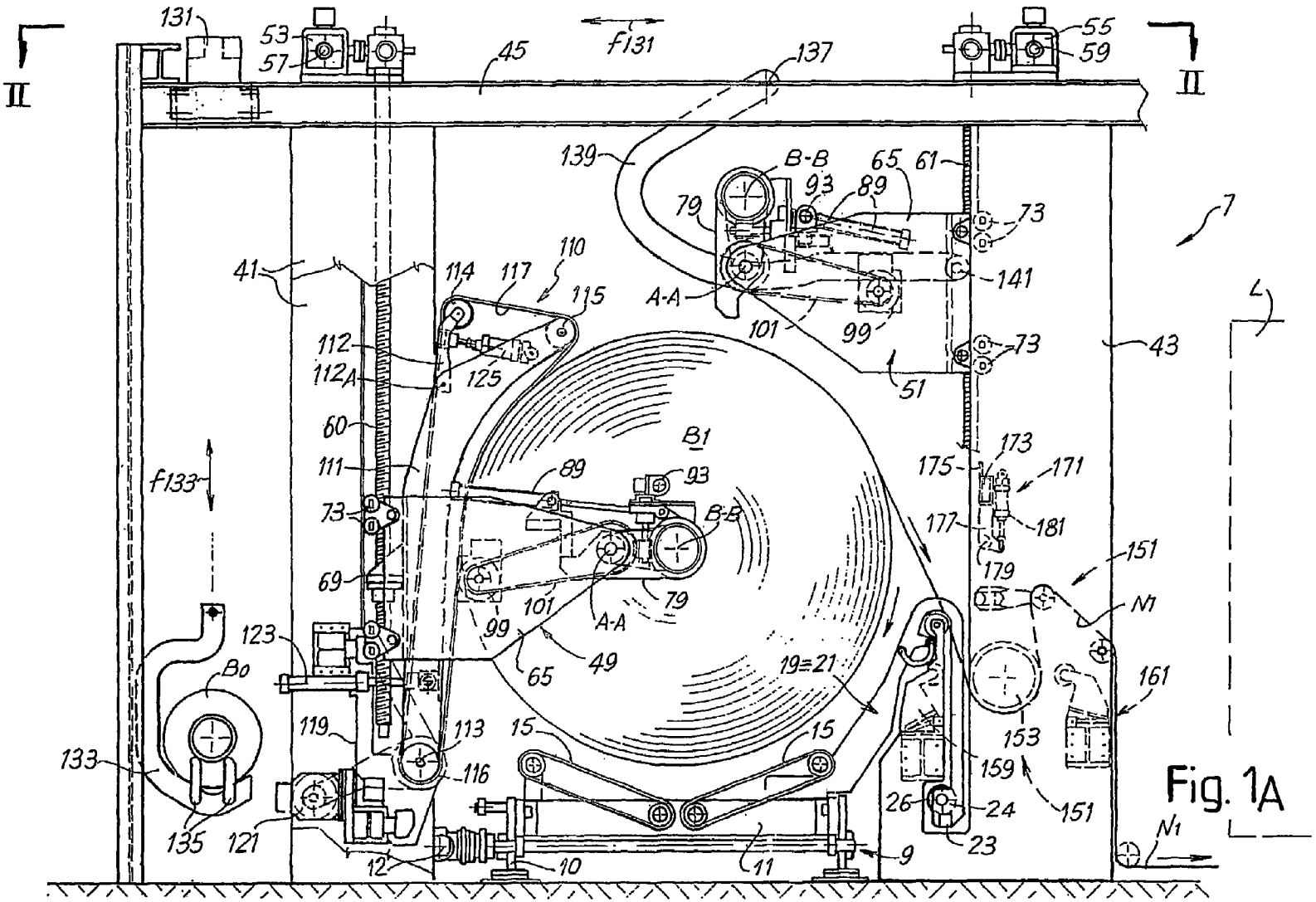
FIGS. 1A-1K show side views of the unwinding station in a series of successive positions during reel changing.

The unwinder device in accordance with the invention, generically indicated by reference 1, in the illustrated example includes a loading station 3 arranged at the side of an unwinding station 7. A shuttle or carriage 9 (see FIG. 2 in particular) is provided with reciprocating translatory motion in the directions of the double arrow f9 for moving between the loading station 3 and the unwinding station 7. With specific reference to the plan view in FIG. 2, by moving the shuttle 9 to the right it can transfer the reel B2 to the unwinding station 7.

Figure 3:
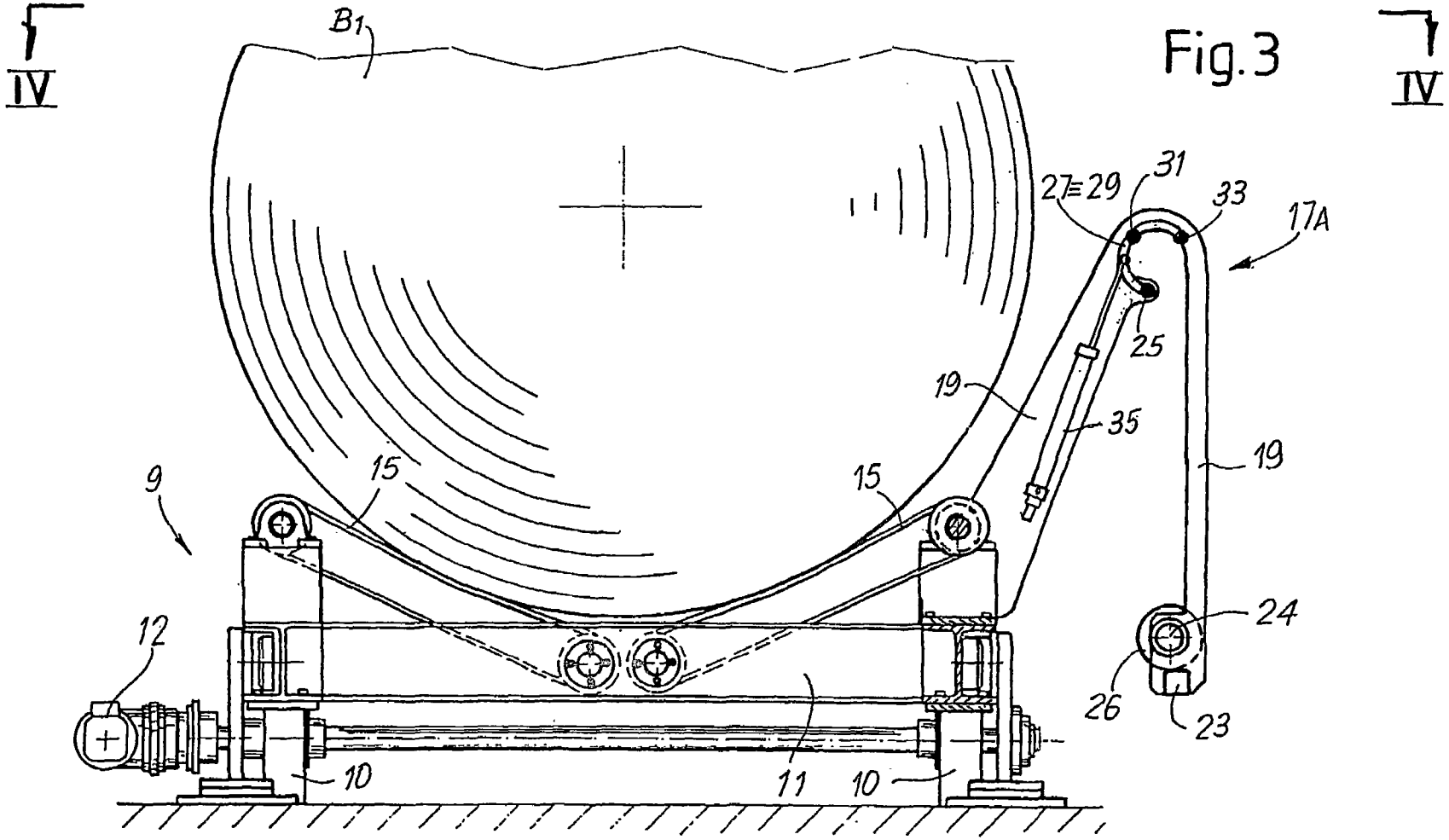
Figure 4:
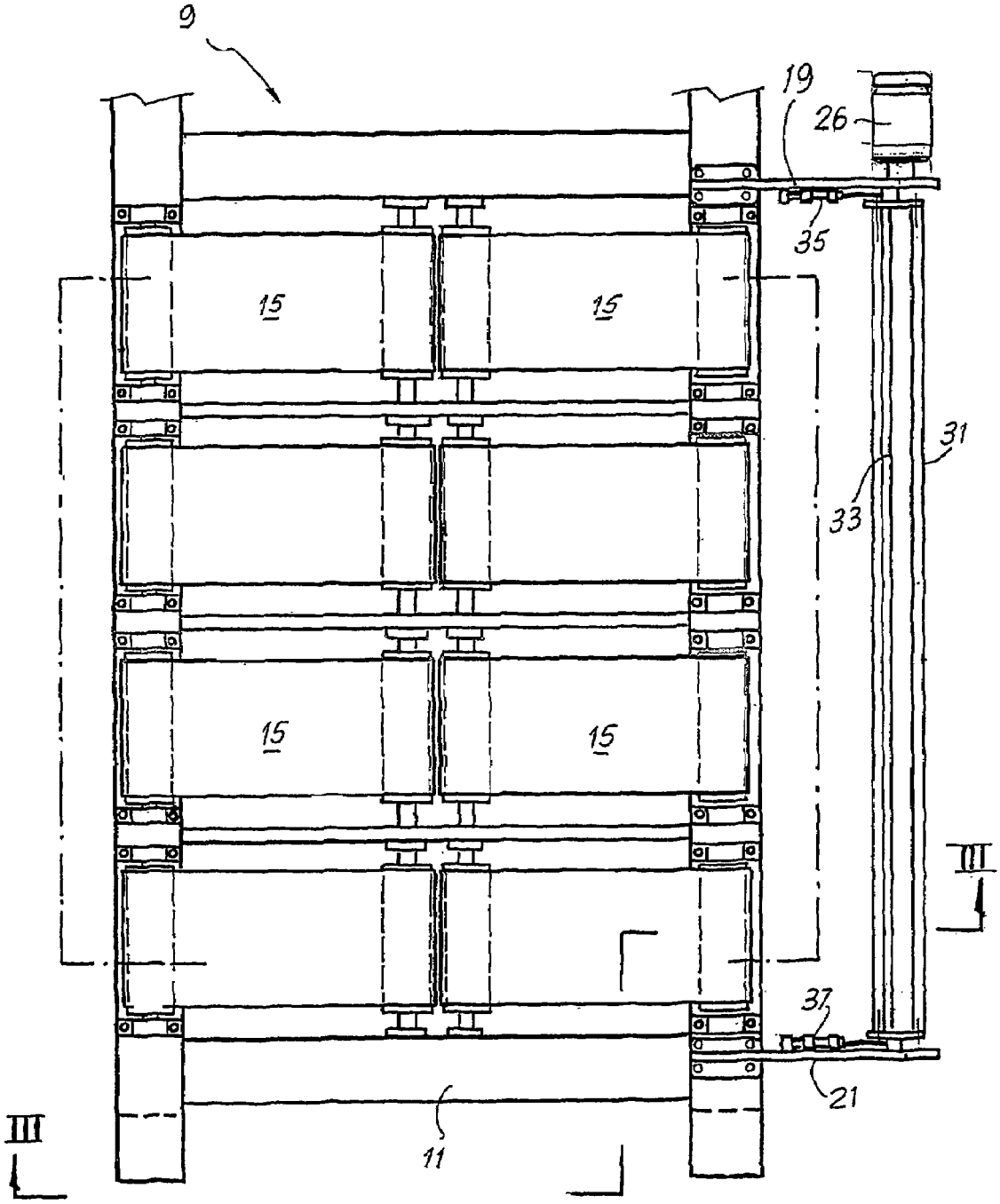
FIG. 4 shows a plan view along IV-IV of FIG. 3, FIGS. 5A and 5B show a lateral view one of the means of support for the reels in two different positions.
Figure 7B:
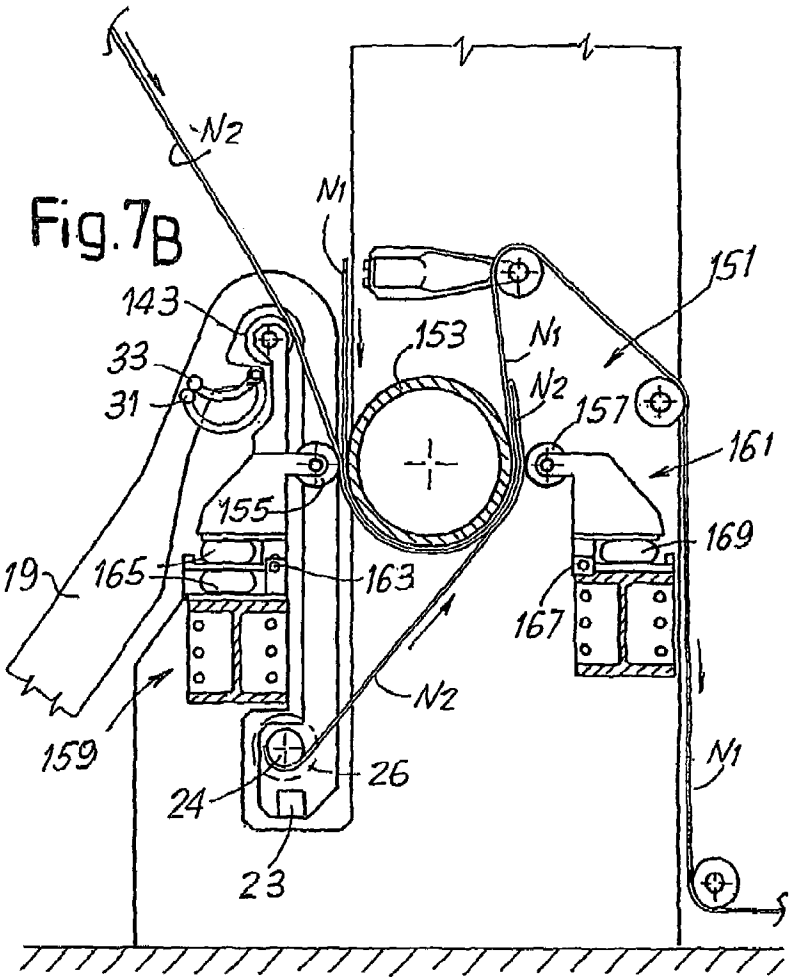
FIGS. 7A and 7B show an enlarged schematic lateral view of the splicing device and the accumulator member, in two different positions during splicing of the two web-like materials coming from the two reels.
Figure 7A:
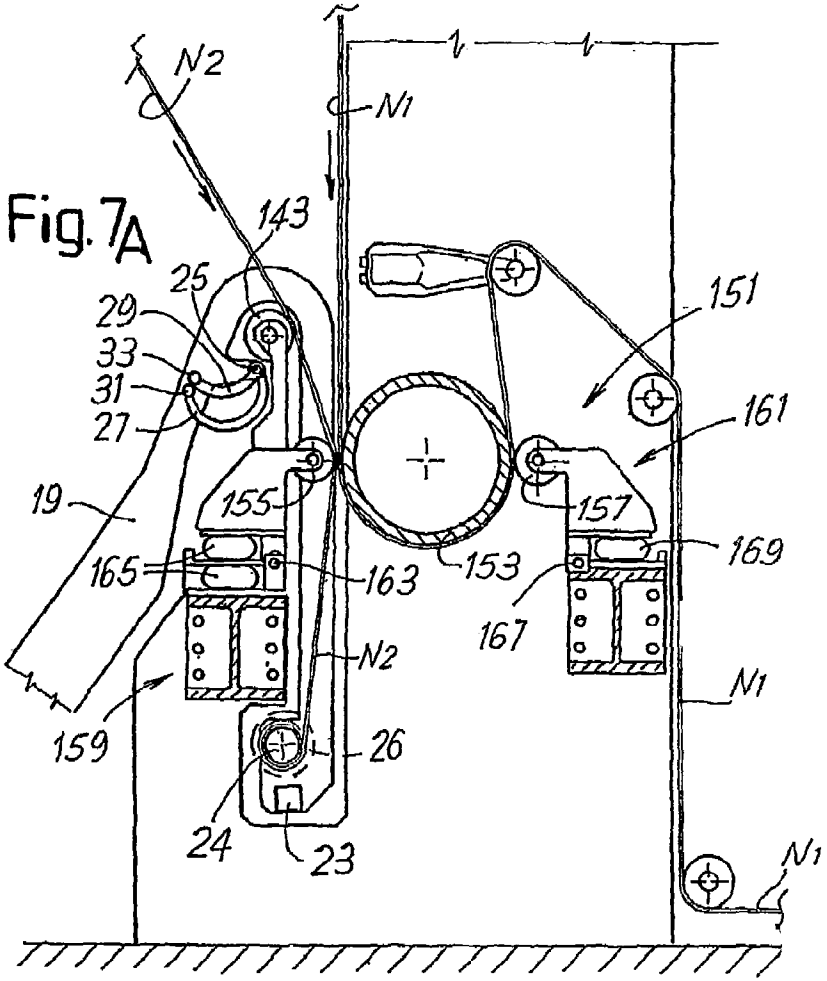

As can be seen in FIGS. 3 and 4 in particular, where the shuttle 9 is shown separately from the other members of the unwinder device, the shuttle has a structure or frame 11 equipped with wheels 10 driven by a motor 12, that provides motion in the directions of the double arrow f9. On the frame 11, support belts 15 with a V-shaped arrangement are provided to create a support cradle for the reels. Each reel placed on the shuffle 9 is oriented with its own axis parallel to the direction of movement of the shuttle 9 itself. A retainer member is associated with the support cradle for the free leading edge of every reel each time one is placed on the shuttle, this member indicated as a whole by reference 17 in FIG. 4. The retainer member 17 has a pair of sides rigidly bound to the structure or frame 11 of the carriage or shuttle 9, approximately shaped like an inverted V, and indicated by references 19 and 21. As can be seen in the enlargements of FIGS. 7A and 7B in particular, a bar 23 runs between the sides 19 and 21 parallel to the direction of movement of the shuttle 9 and which has an edge destined to facilitate the straight cutting of the leading edge of the web-like material wound on each reel placed onboard the trolley or shuttle 9.

The bar 23 is applied close to the lower ends of the respective, substantially vertical arms of the sides 19 and 21. These substantially vertical arms are connected at the top to an inclined arm integral with the frame 11 of the shuttle 9. In the zone of convergence, corresponding to the vertex of the inverted V, the two sides define an empty space for purposes that will be shortly become clear. A pivot axis 25 passes slightly below the zone of convergence of the two arms forming the sides 19 and 21, around which axis a pair of semicircular members 27 and 29 associated to each side 19 and 21 rotate. Rollers or rods 31 and 33 are constrained to each pair of semicircular members 27 or 29. Respective cylinder-piston actuators 35 and 37 are associated with the sides 19 and 21 for controlling the oscillation of the semicircular members 25 and 27 for purposes that will become clear in the following.

The vertical arms of the sides 19 and 21 carrying the bar 23 also support a suction roll 24, motorized via a motor 26, the purpose of which will be explained in the following in reference to the principle of operation of the unwinder device.

The unwinding station 7 (see FIG. 1A in particular) includes a pair of vertical uprights 41 and 43 joined by a horizontal tie beam 45. Inside this portal-like structure 41, 43 and 45, a space is delimited through which the shuttle 9 transits in its movement of transferring reels from the loading stations 3 and 5 to the unwinding station 7. Actually, each upright 41 and 43 is double, as can be seen in FIG. 2 in particular. Two arms, indicated as a whole by reference 49, slide vertically on the double upright 41, defining a first support for a first reel in the unwinding position in the station 7. The two arms 49 are shown separately in the enlargement in FIG. 6 and will be described in greater detail further on. A similar pair of arms 51 is vertically mobile along the double upright 43 and defines a second support for a second reel inside the unwinding station 7. The raising and lowering movement of each pair of arms 49 and 51 is driven by respective motors 53 and 55, via horizontal shafts 57 and 59. The shafts 57 and 59 transmit the drive via angle transmissions and auxiliary shafts, each to a pair of vertical threaded rods 60 for the arms 49 and 61 for the arms 51 (see FIG. 2 in particular).

Figure 5A:
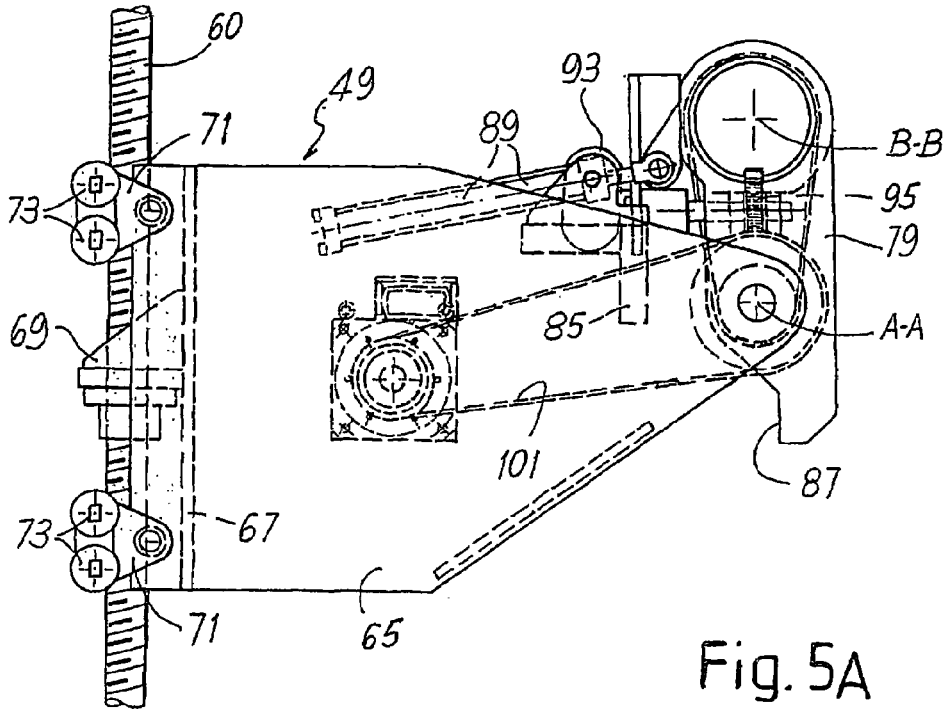
Figure 5B:
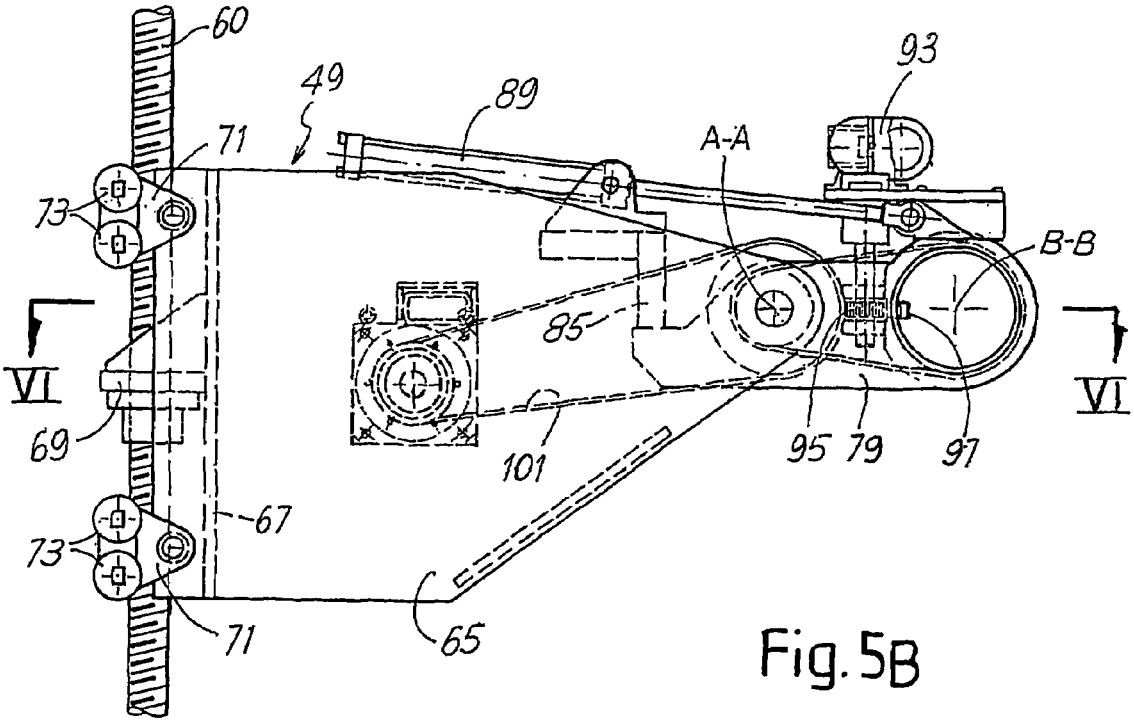
Figure 6:
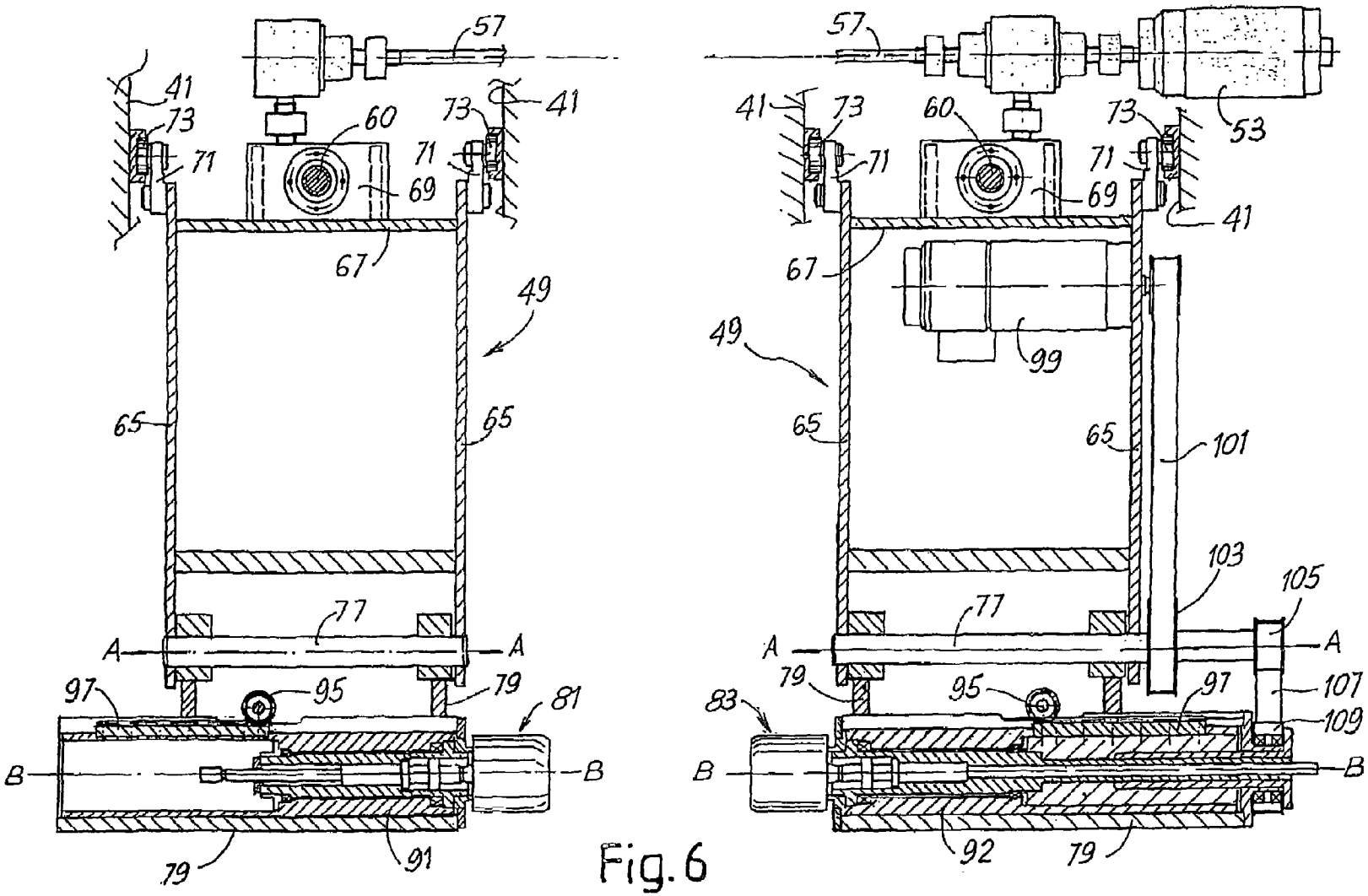
FIG. 6 shows a sectional view along VI-VI of FIG. 5B of one of the means of support of the reel.

The arms 49 are substantially identical to the arms 51 and therefore only the arms 49 will be described in reference to FIG. 6. Each of said arms has a pair of sides 65 constrained by a cross beam 67 that carries a nut screw 69 engaged on the respective threaded rod 59. The sides 65 are integral with support plates 71 (see FIG. 5A and FIG. 5B) carrying guide rolls 73 along the uprights 41. As can be seen in FIG. 6 in particular, at the opposite ends of the sides 65 with respect to the position of the rolls 73, shafts 77 are provided for each arm 49, with horizontal axes A-A around which the groups 79 oscillate, each of which carries a respective spindle or tailstock 81, 83. The spindle-carrier or tail-stock-carrier groups 79 can assume two positions, shown in FIGS. 5A and 5B. In the position shown in FIG. 5A, the axis of the tailstocks 81 and 83, indicated by B-B and parallel to the oscillation axis A-A of the tailstock-carrier groups 79, is above the oscillation axis A-A. Conversely, in FIG. 5B, the axes B-B and A-A are aligned on a horizontal plane. This position is defined by a fixed stop 85 integral with the sides 65 and by a mobile stop 87 integral with the respective tailstock-carrier group 79. The oscillating movement of the tailstock-carrier groups 79 is controlled by a respective cylinder-piston actuator 89 carried by each arm 49 (FIGS. 5A and 5B).

As can be seen in the cross section of FIG. 6 in particular, the tailstock 81 is freely mounted on a sleeve 91 sliding inside, the tailstock-carrier 79 and the translatory motion of which along the axis B-B of the tailstock itself is driven by a motor 93 via a rack and pinion transmission 95 and 97. A similar arrangement, indicated with the same reference numbers, is provided for driving the translatory motion of the sleeve 92 of the tailstock 83 along its own axis. However, to the contrary of tailstock 81, the tailstock 83 is not idle, but driven in rotation around its own axis by a motor 99 and transmission including a first belt 101, a pulley 103 on the A-A axis, a second pulley 105, a second belt 107 and a pulley 109 fitted on the axis of the tailstock 83.

Between the two elements forming the double upright 41, a surface unwinding member, indicated as a whole by reference 110, is arranged for the purpose (as will be described in greater detail further on), of unwinding the reels of web-like material for a significant part of the unwinding cycle, possibly in combination with the central unwinding members associated with the two reel support arms. The surface unwinding member 110 includes oscillating arms 111 hinged around a horizontal axis 113 parallel to the direction of translation of the shuttle 9. The surface unwinding member 110 is substantially removed from the view in FIG. 2 for drawing clarity, but is clearly illustrated in FIGS. 1A-1K. The pair of oscillating arms 111 carries three rolls 114, 115 and 116 with parallel axes that are also parallel to the axis of oscillation 113 of the arms 111, around which belts 117 are run to form the means of transmission of the unwinding motion to the reels. A guide roll 116, coaxial with the axis of oscillation 113 of the arms 111, is driven in rotation by a belt 119 that is driven by a motor 121. The oscillatory movement of the arms 111 is imparted by a cylinder-piston actuator 123, while the tension of the belts 117 is controlled by a cylinder-piston actuator 125 carried by the arms 111, hinged at one end to said arms 111 and at the other end to auxiliary arms 112 carrying the transfer roll 114 and hinged around an axis of oscillation 112A carried by the arms 111. The tensioning of the belts 117 and the movement of the arms 111 are controlled using known methods and are not described.

A collection device 131 for empty reels can be moved along the tie beam 45, in the directions indicated by the double arrow f131. The collection device 131 has a vertically mobile cradle 133 which can move in the directions indicated by the double arrow f133 between two end positions shown in FIGS. 1A and 1B for discharging empty reels onto a conveyor 135 or other removal device. The collection device 131 and the respective cradle 133 also have a horizontal movement up to the position shown in FIG. 1K.

A pair of curved oscillating arms 139 is hinged on the tie beam 45, around an axis 137, parallel to the direction of translation of the shuttle 9. The opposite ends of the arms 139 in correspondence to those hinged on the tie beam 45, support a roll 141 (possibly motorized) destined to make contact with the web-like material to deviate the path thereof during the phases of changing a reel that has almost run out with a full reel, as will be described described in further on. The curved arms 139 form a loop so as to encircle the axis of a reel that is running out.

On the side of unwinding station 7 outputting the web-like material, there is a guide roll 143 (see FIGS. 7A and 7B in particular), to which the web-like material unwound from the reel is transferred. The roll 143 can be idle or motorized. Along the path of the web-like material supplied from the unwinding station, downstream of the guide roll 143, a splicing device is provided, indicated generically and as a whole by reference 151, the function of which is that of splicing a web-like material coming from an almost empty reel to the web-like material coming from a new reel waiting and destined to substitute the one running out. The splicing device 151 includes a counter-pressure roll 153 with which rollers 155 and 157 of two respective ply-bonding groups 159 and 161 cooperate. The rollers 155 oscillate around an axis 163 parallel to the axis of the counter-pressure roll 153 and press against the latter under the effect of a pusher member consisting, in this example, of pressure bellows 165. The rollers 157 oscillate around an axis 167 under the force of the pressure bellows 169 or another pusher member. The ply-bonding groups 159 and 161 are known per se and operate in the known manner, and so do not require any additional description in this context.

An interruption member 171 is arranged above the splicing device 151 for cutting the web-like material coming from the reel that is running out after splicing with the web-like material coming from a new full reel. In the illustrated example, the interruption device 171 consists of a bar 173 carrying a toothed blade 175 and constrained by a pair of oscillating arms 177. The oscillation of the arms 177 around the axis of oscillation 179 is controlled by a cylinder-piston actuator 181.

The operation of the unwinder device that has been described up to this moment will now be illustrated with specific reference to the series of FIGS. 1A-1K. In FIG. 1A, the support formed by the two parallel arms 51 is in a raised position on the double upright 43, which will be indicated as the release position. The tailstock-carrier groups 79 associated with the two arms 51 are oriented in a manner such that the axes B-B of the tailstocks are located above the axis A-A of oscillation of the tailstock-carrier groups themselves. The pair of arms 49 forming the other reel support is situated in a lowered position on the double upright 41.

B1 indicates a first reel from which a first web-like material N1 is unwound for feeding a downstream production line, generically and summarily indicated by L. The position of the arms 49 is such that the reel being unwound B1 is slightly raised from the shuttle 9, which has been inserted in the space delimited by the uprights 41 and 43 to bring the reel B1 into the correct position for being grasped and raised by the arms 49 and by the tailstocks they carry. The surface unwinding member 110 is kept with its own belts 117 in pressure contact with the external surface of the reel B1 and the motor 121, driving the belts 117 in rotation, provokes the rotation and thus the unwinding of the reel B1 to supply the web-like material N1. The rotation can also be controlled in combination with the central unwinding member associated with the arms 49, i.e. via motor 99. This is particularly advantageous when the reel has a low density.

The collection device 131 is at the extreme left (in the drawing) of the tie beam 45, i.e. on the other side from where the web-like material is supplied to the processing line L. The cradle 133 of the collection device 131 is in the lower position, for releasing an empty reel, indicated by B0, onto the conveyor 135. The latter can be formed, for example, by a series of rubber wheels or the like.

Figure 1B:
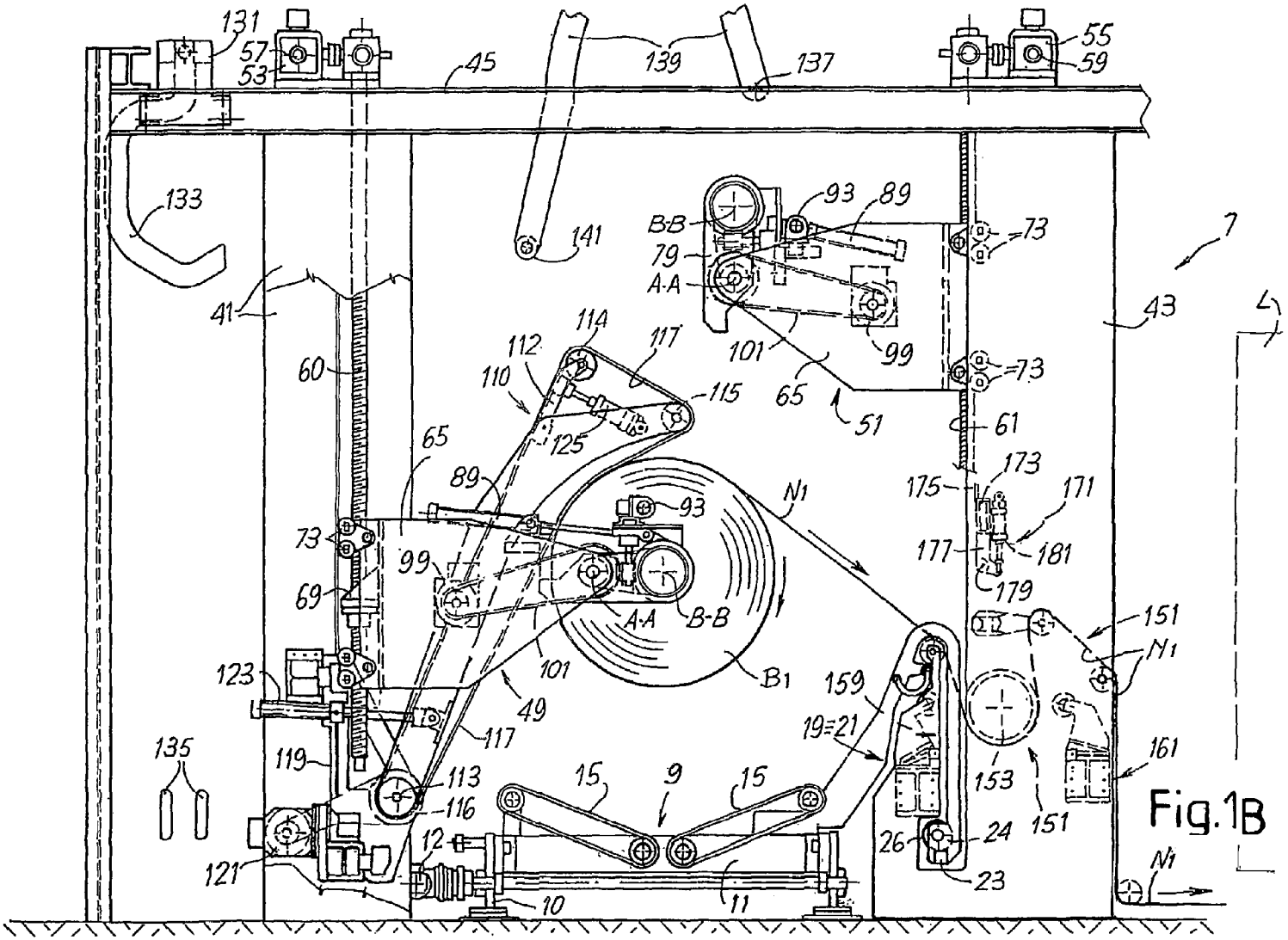
Figure 2:
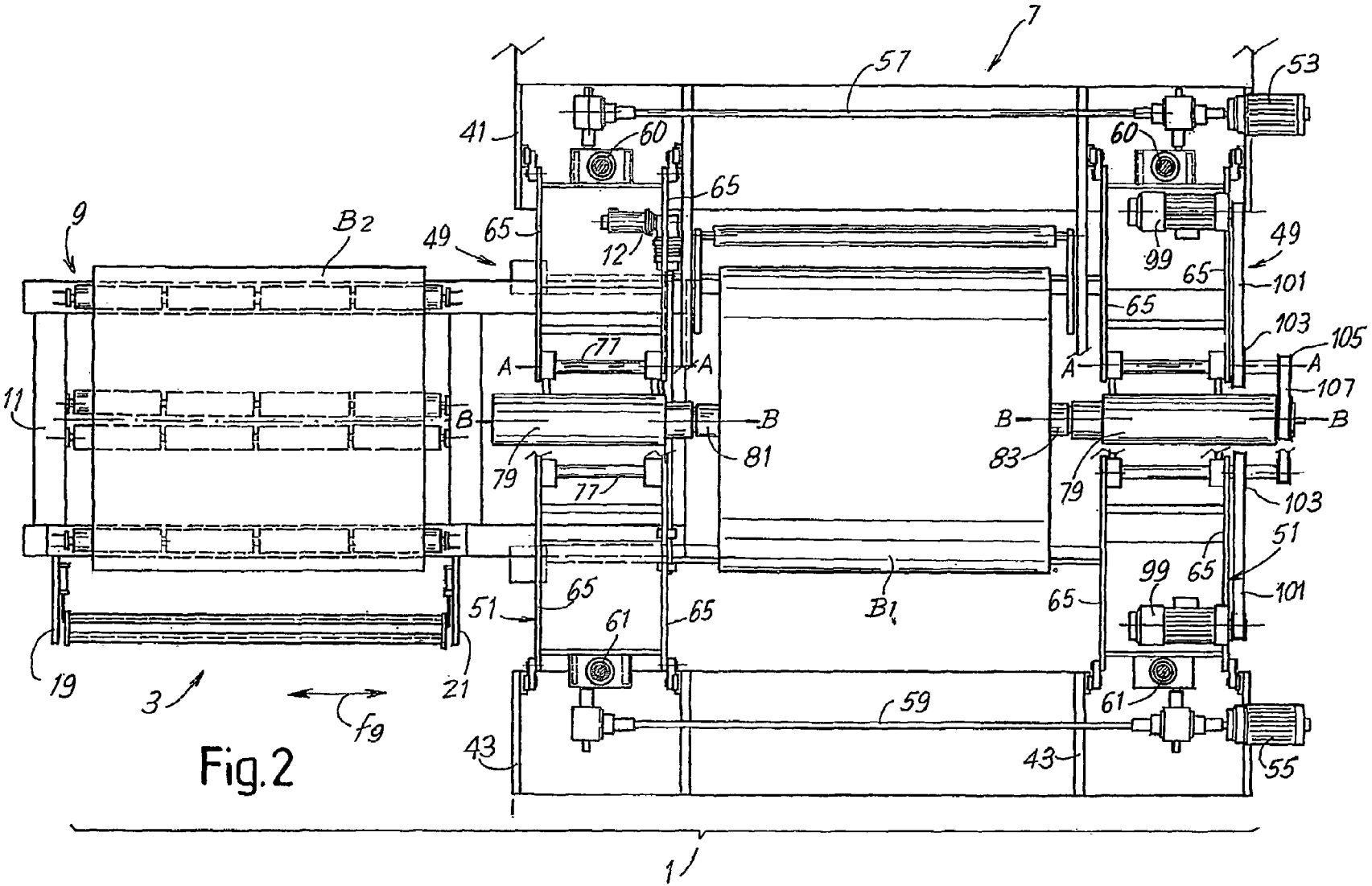
FIG. 2 shows a plan view, partially sectional along II-II of FIG. 1A, with parts removed, FIG. 3 show a lateral view, partially sectional along III-III of FIG. 4, of the shuttle separately from the unwinding station.

In FIG. 1B, the axis of reel B1 in the supply phase is still in the same position of FIG. 1A, i.e. in the position defined by the axis B-B of the tailstocks 81 and 83 of the support formed by the arms 49. The surface unwinding member 110 has rotated in a clockwise direction with respect to the previous figure in order to remain in contact with the reel and to continue to transmit the necessary torque for unwinding it. The curved arms 139 have rotated, with respect to the previous figure, in an anticlockwise direction, while the cradle 133 of the collection device 131 has been brought to a raised position, directly beneath the tie beam 45.

In the unwinding phase illustrated in FIGS. 1A and 1B the torque for maintaining the reel B1 in rotation can be supplied solely by the surface unwinding member 110, or also in combination with the central unwinding member constituted by the motorized tail-stock 83. For example, in a known manner, torque could be applied via a surface unwinding system and also via a central unwinding system, these being coordinated to optimize the conditions of unwinding. For particularly small and/or particularly compact reels it is also possible to imagine using directly and exclusively the central unwinding system via the tailstock 83, thereby eliminating the surface unwinding member 110.

Already in this phase, the shuttle 9 that has brought the reel B1 to the unwinding station 7 can be transferred to the loading station 3, to receive a new reel which shall be inserted in the unwinding station in the successive cycle. It can thus be appreciated that the shuttle does not necessarily have to be a double one, as in traditional machines, although the possibility is not excluded. In the successive figures, the shuttle 9 is always shown in the same position, but it should be understood that it could have been removed from the unwinding station.

Figure 1C:
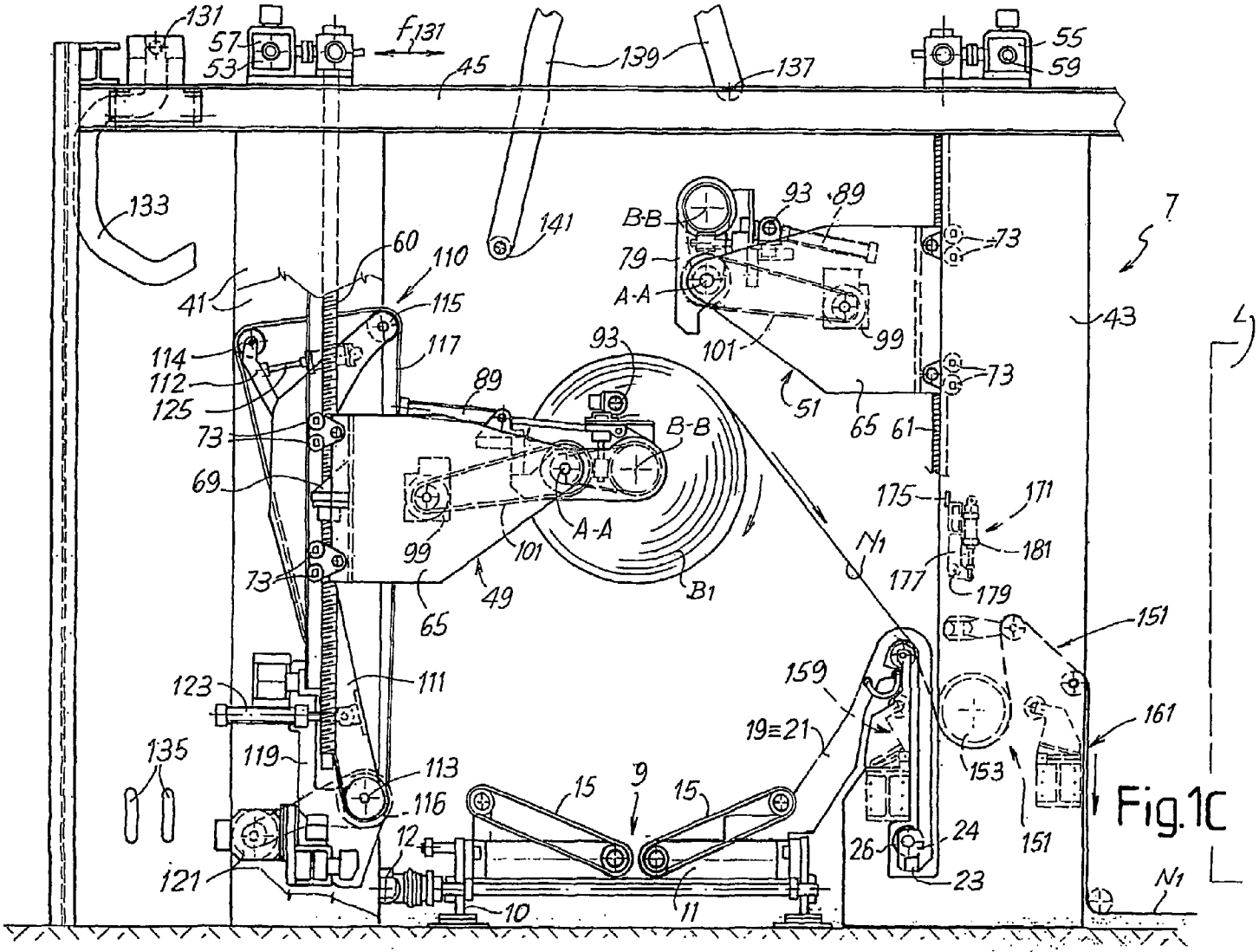

FIG. 1C shows the start of the phase of exchanging reel B1 that is running out with a new reel B2, which must be inserted by the shuttle 9. The insertion takes place with a translational movement of the shuttle 9 in the direction orthogonal to the plane of the figure. The surface unwinding member 110 has been made to swing in the anticlockwise direction to move it away from the reel B1. In this phase the reel B1 is kept in rotation only by the motorized tailstock 83, to continue supplying the web-like material N1 in a substantially continuous manner to the downstream production line. The pair of arms 49 has started to move upwards towards the tie beam 45.

Figure 1D:
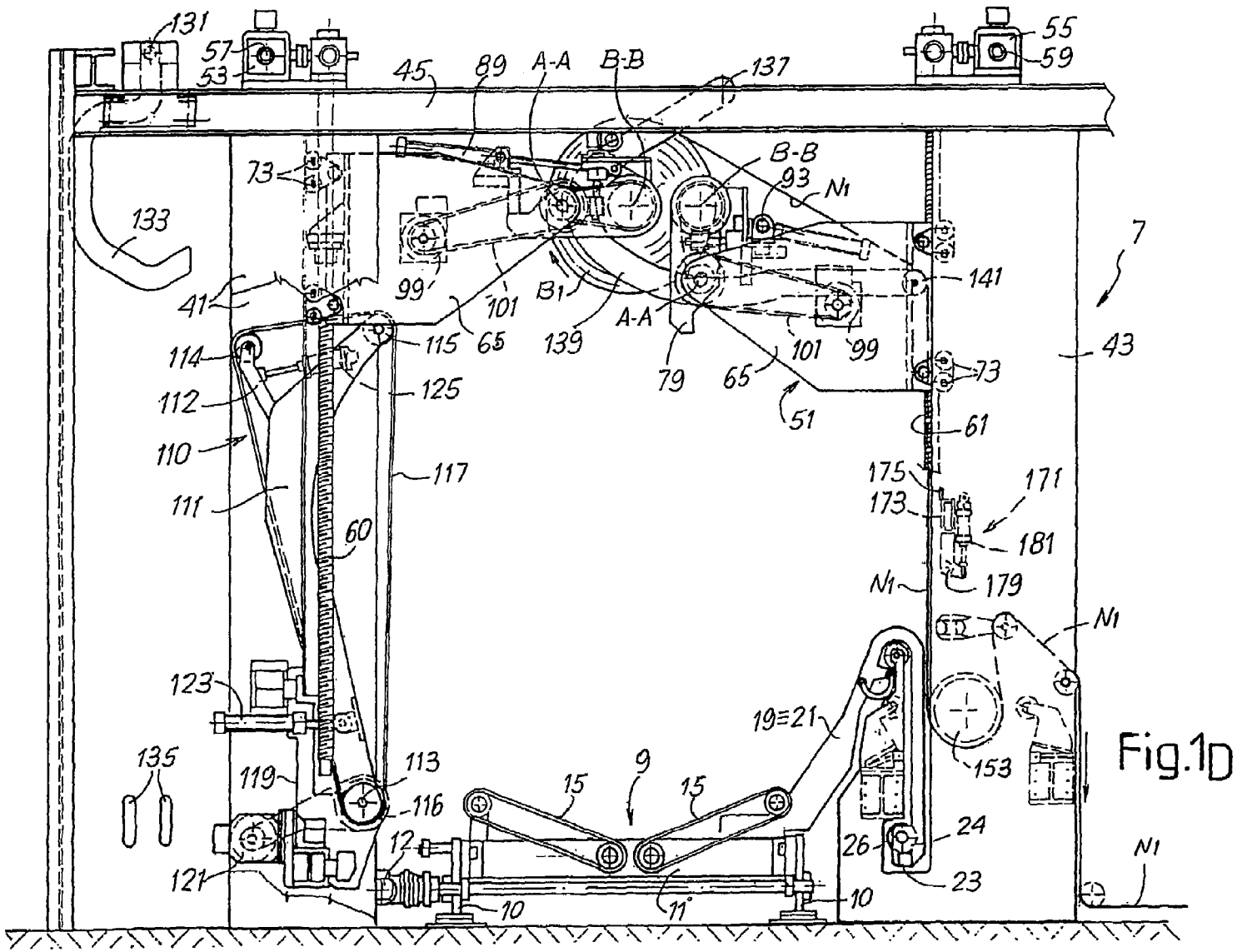

In the successive FIG. 1D the pair of arms 49 has reached the position of maximum lift, also designated as the release position, because in this position (after the web-like material wound on the reel B1 has run out) the tailstocks 81 and 83 will be extracted from the central axis of the empty reel to release it to the collection device 131. The pair of curved arms 139 has been rotated to bring it into the angular position illustrated in FIG. 1A. The distance between the two curved arms 139 is greater than the width of the web-like material wound on the reel so that they can be brought close to the axis of the reel itself. In this position, all of the space between the uprights 41 and 43 is free and the shuttle 9 can transit for inserting in this space a new reel destined to substitute the reel B1 in the phase of running out. In fact, the path of the web-like material N1 from the reel B1 to the transformation line has been deviated by the action of the oscillating curved arms 139, the function of which is exactly that of moving the web-like material being supplied away from the space in which a new reel must be inserted.

As can be seen in FIG. 1D, thanks to the fact that the tailstocks 81 and 83 of the pair of arms 51 are made to swing in an clockwise direction around the axis A-A to bring their axes B-B into vertical alignment above the axis A-A, the rising motion of the arms 49 does not cause collision between the tailstocks of the two pairs of arms 49 and 51. The reel B1 does not collide with the tailstocks of the arms 51 as the latter are in an axially retracted position, i.e. at maximum reciprocal distance. In this position, the distance between the tailstocks is greater than the height, i.e. the axial length, of the reels handled by the unwinder device.

Figure 1E:
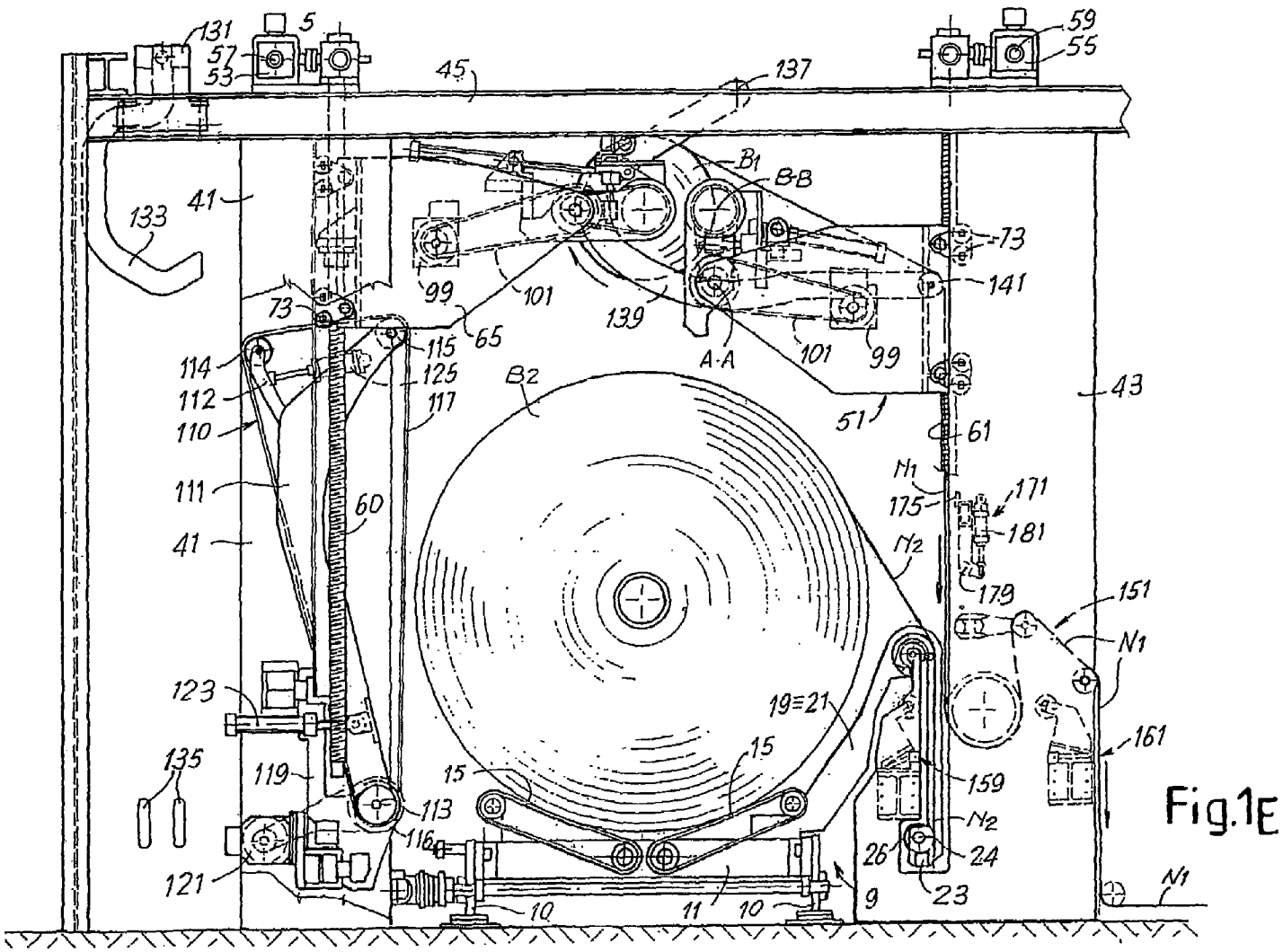

FIG. 1E shows the device in the same condition as the previous figure, but after the translation of the shuttle 9 that has brought a new reel, indicated by B2, between the uprights 41 and 43, and on which a second web-like material indicated by N2 is wound. The free leading or head edge of the web-like material N2 has been trimmed and prepared while the reel was in the loading station 5 or 3. As previously mentioned, for trimming the web-like material a bar 23 is provided that constitutes a guide for the cutting blade or other cutting tool used by the operator for creating a clean edge on the web-like material. This edge is then fixed to the roll 24. As mentioned, this can be a suction roll, for holding the free edge of web-like material. The semicircular members 27 and 29 are in the position shown in FIG. 1E in order to support the initial section of the web-like material above the fixed-axis guide roll 143. This permits the shuttle 9 to travel from the loading position to the unwinding position without the web-like material prepared on it interfering with the guide roll 143. Once the reel B2 has reached the position in FIG. 1E, the semicircular members 27 and 29 can be returned to the retracted position shown in FIG. 7A, so that the web-like material N2 rests on the guide roll 143.

Figure 1F:
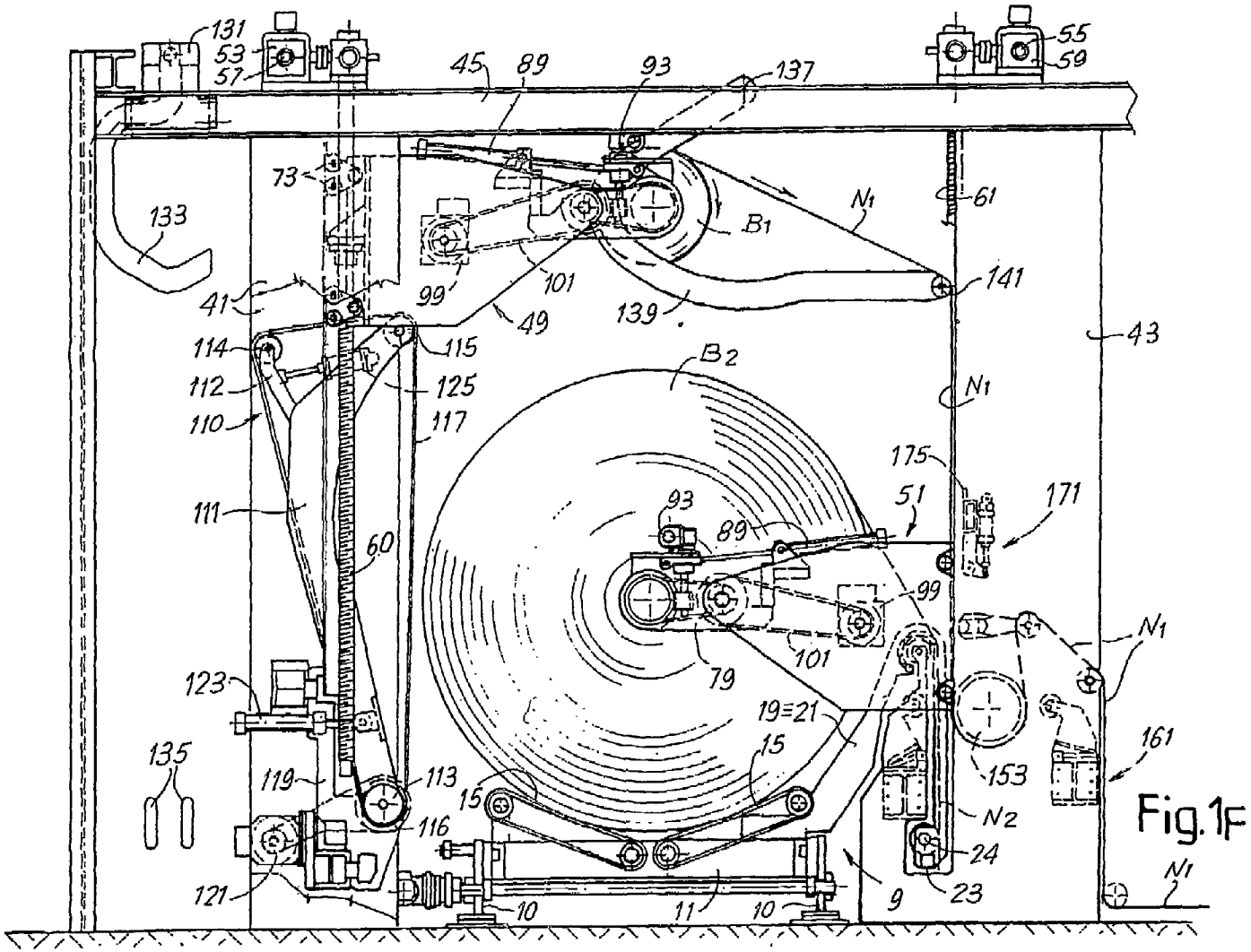

In the following FIG. 1F, the pair of aims 51, forming the second support for the reels in the unwinder device has been brought into the lower position on the uprights 43. This position is also called the engagement position, because it is the position in which the reel is engaged by the tailstocks. The tailstock-carrier groups 79 have been made to swing in the anticlockwise direction to bring the axes of the tailstocks 81 and 83 associated with the arms 51 into a position horizontally aligned with the axis A-A of oscillation of the tail-stock-carrier groups 79. In this condition, the axis B-B of the two tailstocks 81 and 83 carried by the arms 51 is in the same position in which the axes of the tailstocks 81 and 83 carried by the arms 49 were in the previous phase of taking the reel B1 from the shuttle 9. This allows just a translational movement to be given to the shuttle 9 in the direction orthogonal to the plane of the figure. Alternatively, if changing the geometric set-up of the tailstocks with respect to the arms 49 e 51 that carry them were not contemplated, it would be possible to arrange these arms at a reciprocal distance sufficient to avoid collisions, and give an additional translational movement to the reel insertion system, for example by equipping the shuttle 9 with a slide providing a movement orthogonal to the insertion and extraction direction of the shuttle 9 with respect to the unwinding station 7.

Figure 1G:
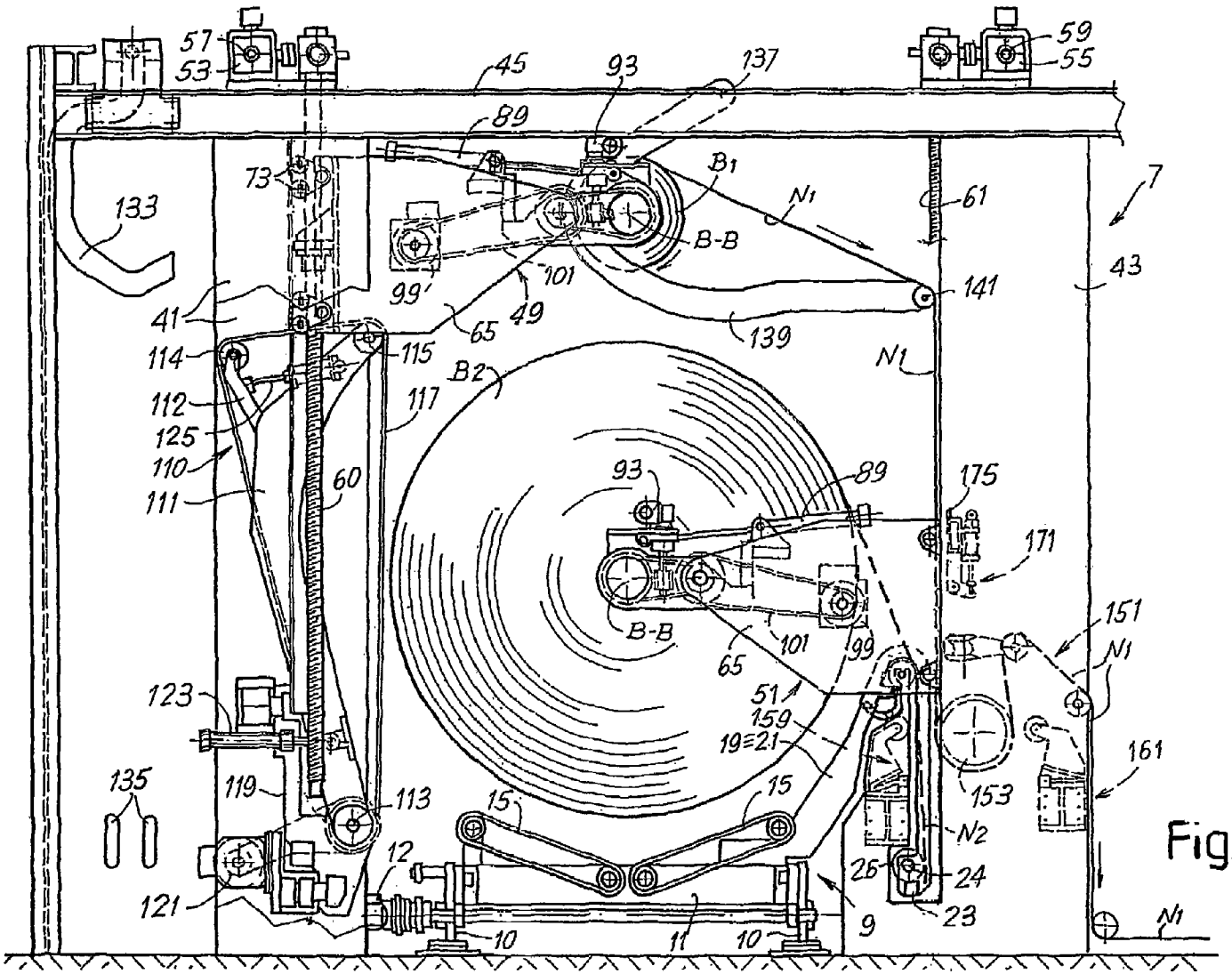

In FIG. 1G the pair of arms 51 has been slightly raised to bring the axis of the reel B2 into the same position assumed in FIG. 1A by the axis of reel B1. In this way, as reel B2 has lost contact with the support belts 15 provided on the shuttle 9, it is possible to start rotation of the reel B2.

Figure 1H:
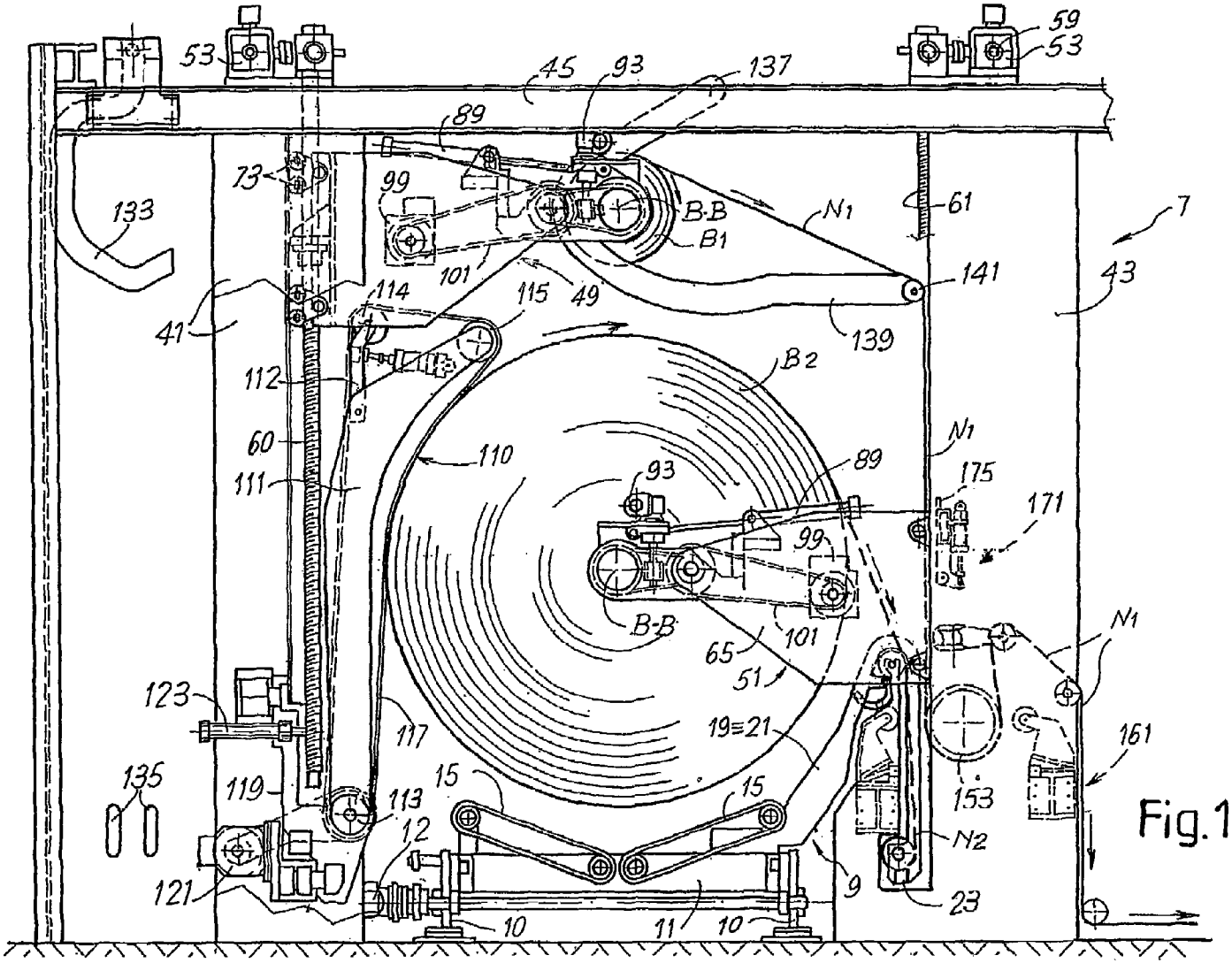

As can be seen in FIG. 1H, at this point the surface unwinding member 110 is made to swing in the clockwise direction to bring the belts 117 into contact with the outer cylindrical surface of the reel B2; to start the unwinding of the reel itself. The motor 121 is started with a suitable acceleration ramp and starts to make the reel B2 rotate. It is angularly accelerated until the speed of the web-like material N2 (and thus the peripheral speed of the reel) reaches the feed speed of the web-like material N1 coming from reel B1. The feed speed of the web-like material N1 can be temporarily reduced if appropriate.

The time necessary for bringing the peripheral speed of the second reel B2 up to the peripheral speed of the first reel B1 is relatively short. The web-like material N2 that is supplied by the reel B2 in this phase is collected around a motorized roll 24 to which the leading edge of the web-like material has been attached beforehand. To that end, the motor 26 is operated, the speed of which is suitably controlled according to the peripheral speed of the reel B2. Before performing the splicing of the web-like material N2 with the web-like material N1, said two materials pass through the rollers 155 of the ply-bonding group 159 and the counter-pressure roll 153, which also serves as a guide and idle roll for the web-like material fed to the downstream production line, before these two elements are pressed against each other.

Figure 1I:
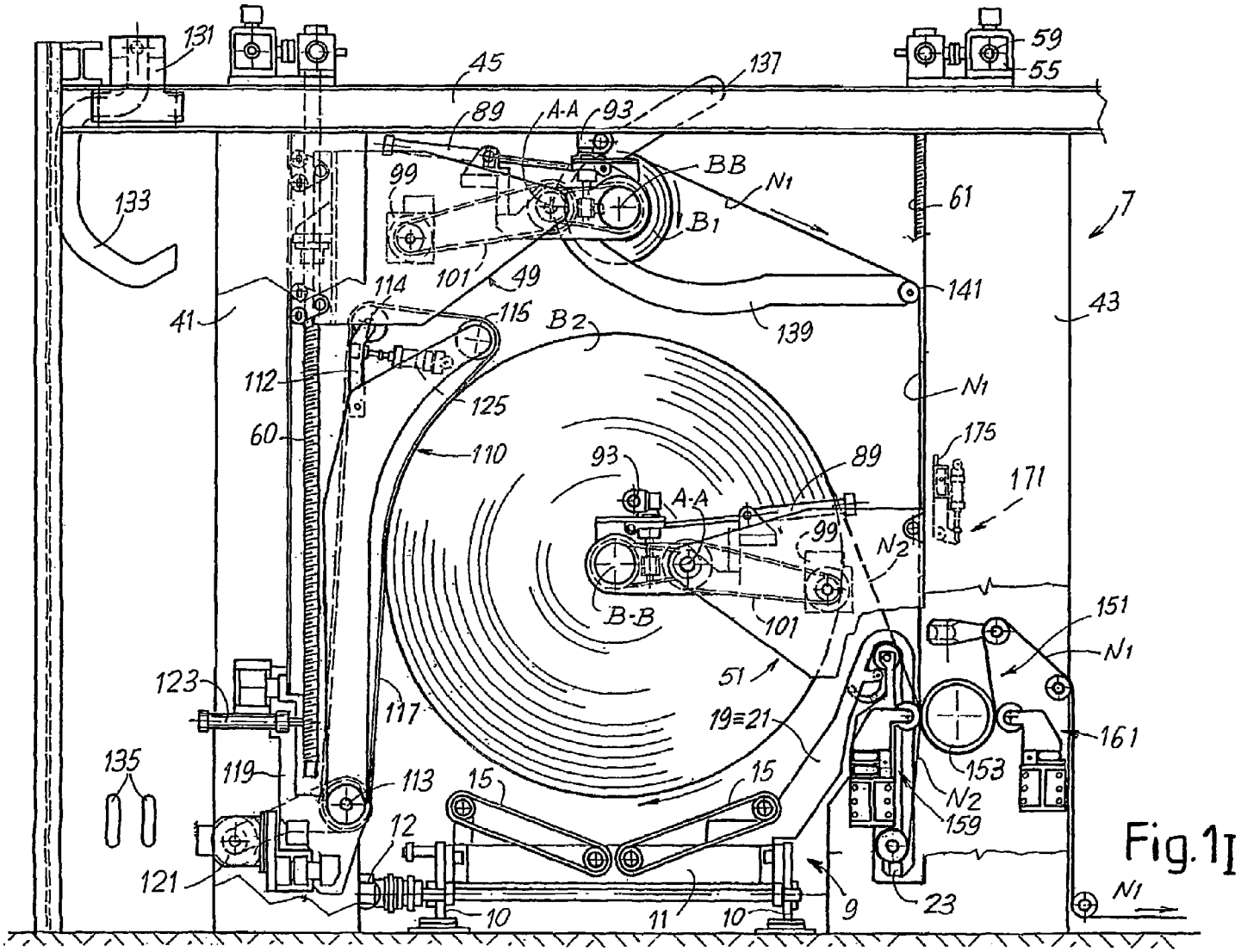

In the successive FIG. 1I the splicing phase of the web-like material N1 coming from the almost empty reel B1 with the web-like material N2 coming from the reel B2 is shown. To this end, the ply-bonding groups 159 and 161 are operated to bring the respective rollers 155 and 157 to press against the counter-pressure roll 153. The position taken by these members in this phase is illustrated in FIG. 7A. The two series of ply-bonding rollers 155 and 157 splice under pressure the two web-like materials, which are fed in parallel and at the same speed.

As part of the web-like material N2 was wound around the roll 24 during the phase of acceleration of the reel B2, to automatically retrieve this portion of web-like material, once the above-described splicing operation has commenced via the closure of the ply-bonding groups it is possible to slow down and then invert the direction of rotation of the motor 26 and the roll 24 to output the head of the web-like material N2 to the transformation line L together with the web-like material N1 still in the phase of supply from the reel B1 and the web-like material N2 being unwound from the reel B2. This situation is shown in detail in FIG. 7B.

Figure 1J:
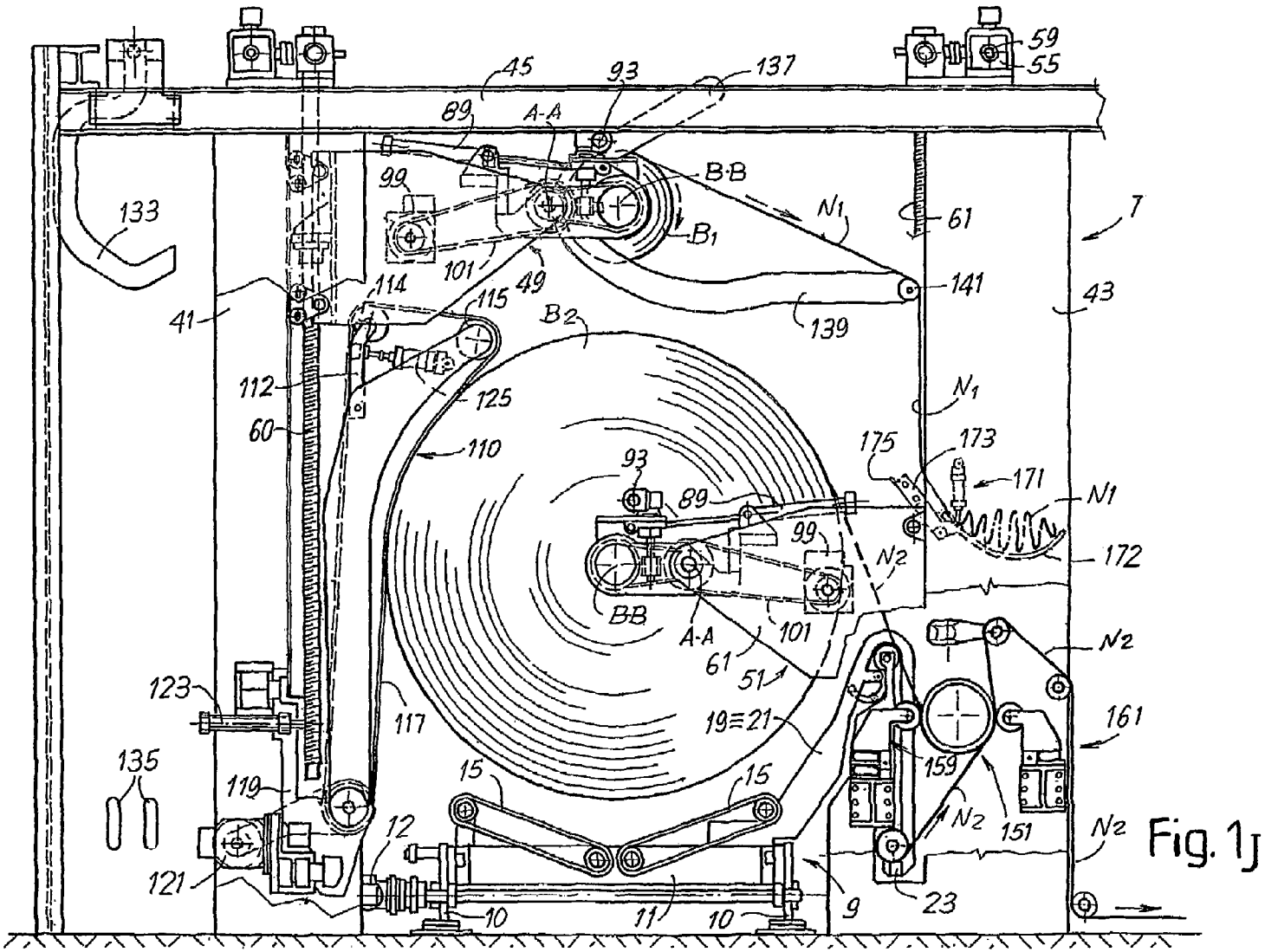

At a suitable moment in this phase of operation, the web-like material N1 coming from the first reel B1 is cut via the interruption member 171. The cutting or interruption phase of web-like material coming from the almost empty reel B1 is shown in FIG. 1J. After the start of the splicing operation and up to the passage of the tail of the web-like material N1 and the head of the material N2 through the splicing device 151, a material formed of three layers is fed from the splicing device 151, i.e. the web-like material N1 and the web-like material N2 doubled. After the passage of the head of the web-like material N2 that detaches itself from the roll 24 and the tail of the web-like material N1 through the nip formed by the counter-pressure roll 153 and the ply-bonding rollers 157, at the output of the splicing device 151 there will again be material composed of a single layer only, i.e. the web-like material N2, that starts the regular feed to the downstream converting line. The section in which the splice was formed will be discarded downstream by known systems and recycled.

Figure 1K:
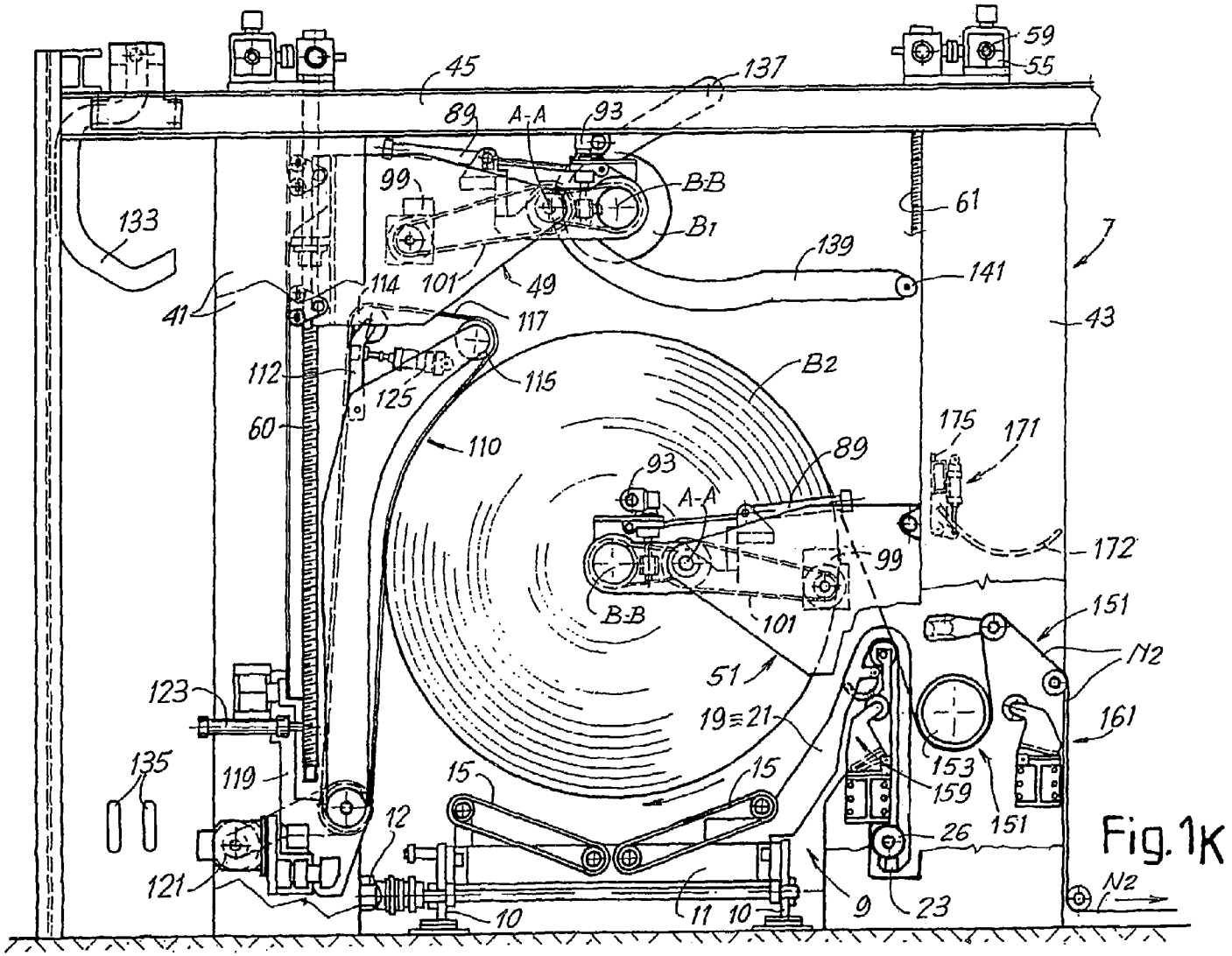

In the successive FIG. 1K it is shown how the collection device 131 retrieves the empty reel B1 that is released by the tailstocks 81 and 83 on the cradle 133. The collection device then moves to a position similar to that in FIG. 1A, with the cradle 133 in the low position for discharging the residue of the reel B1.

As can be seen comparing FIGS. 1A and 1K, the supply of the web-like material N2 continues with the unwinder device in a setup substantially symmetrical to that shown in FIG. 1A. When the reel B2 runs out, the device will perform a substitution cycle substantially symmetrical to that described, where the arms 49 and 51, with the respective members that they carry, will perform partially inverted operations with respect to that described above.

From the above, it will be appreciated that the above-described unwinder device is capable of performing the substitution of an almost empty reel with a new reel and splicing the web-like material coming from the almost empty reel with the web-like material coming from the new reel without halting supply to the downstream production line and also retrieve all of the web-like material unwound from the new reel during the splicing phase, for simplifying the recycling operations. No residues of web-like material remain on the shuttle 9. The portion of web-like material N1 partially unwound from the emptied reel B1 (between this and the interruption device 171), is recovered around the tubular core of the reel B1 by inverting the direction of rotation of the tailstock 83 of the respective pair of arms 51, such that it cannot hamper unloading operations.

As the reel B1 that is running out must be slowed down until it stops after the cutting of the web-like material N1 has been performed, this continues to be unwound for a certain length until the direction of rotation of the reel B1 is inverted to permit its retrieval. To avoid this residual portion of web-like material N1 interfering with other members of the machine, and in particular with the members of the splicing device, a collection element is advantageously provided, in the form of a curved surface 172 or other system of containment.

The usage of two ply-bonding groups 159 and 161 as described above ensures that on the portion of material where the splice is made between the web-like materials N1 and N2 there are no free edges that can hamper the feeding of the material itself. The fact, when the first ply-bonding group 159 closes to make the splice, a ply-bonding spliced zone between the two web-like materials N1 and N2 starts to be created. Without the second ply-bonding group 161, the portion of web-like material temporarily accumulated on the roll 24 would simply be dragged by the material after splicing, remaining free with the risk of running astray. The presence of the second ply-bonding group makes sure that this portion of web-like material N2 is caused to adhere by ply-bonding to the material that advances in a controlled and not a free manner to the downstream converting line L. The second ply-bonding group also guarantees a more reliable splicing of the layers, exerting sufficient traction on the portion of material temporarily wound and accumulated on the roll 24, to facilitate retrieval.

The particular arrangement of the roll 24 for the temporary accumulation of the web-like material N2 coming from the reel B2 downstream of the position of the first ply-bonding group 159, i.e. of the zone in which the web-like materials N1 and N2 are spliced, allows the second reel B2 to be accelerated significantly before performing the splicing, and thus essentially of not excessively reducing the feed speed of the web-like material. At the same time, contrary to known devices, it is not necessary to have a large distance between the splicing members and the position of the reels being unwound. As can be observed in the drawings, the splicing occurs in a position very close to the reels and this permits better control of the web-like material and greater compactness of the production line.

From that described above, it is also clear that one of the advantages of the device in this embodiment is represented by the possibility of retrieving, without manual intervention, the head of the web-like material of the new reel that will substitute the empty reel. This requires the utilization of the motorized roll 26.

Figure 8B:
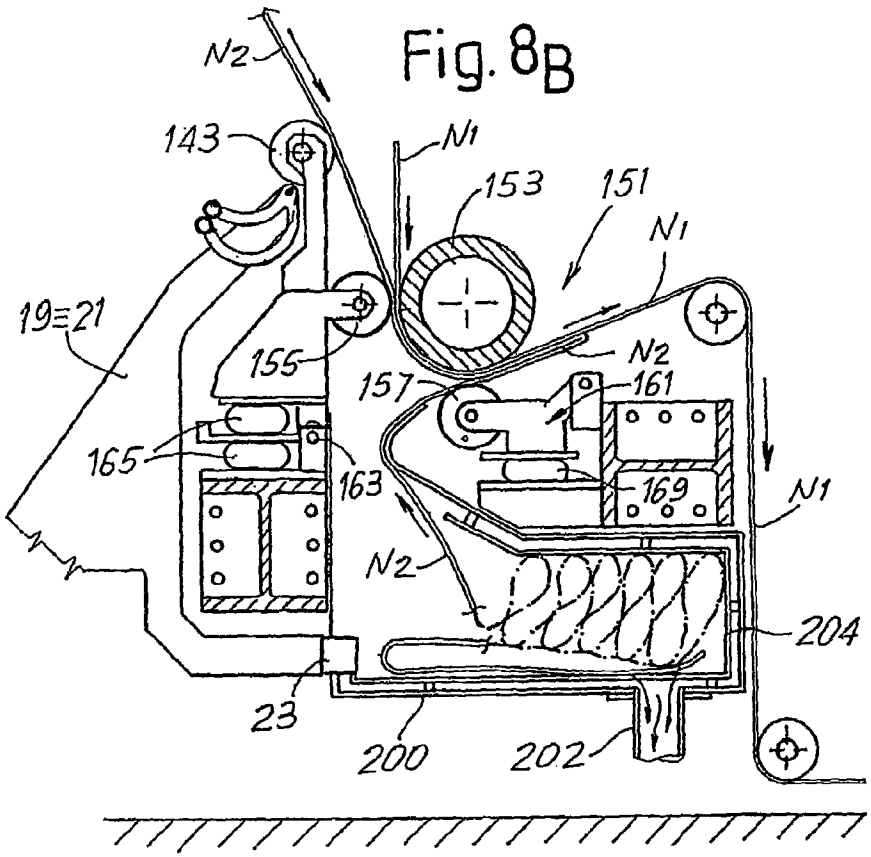
FIGS. 8A and 8B show an enlarged schematic lateral view of a modified embodiment for the accumulator member in two different conditions.
Figure 8A:
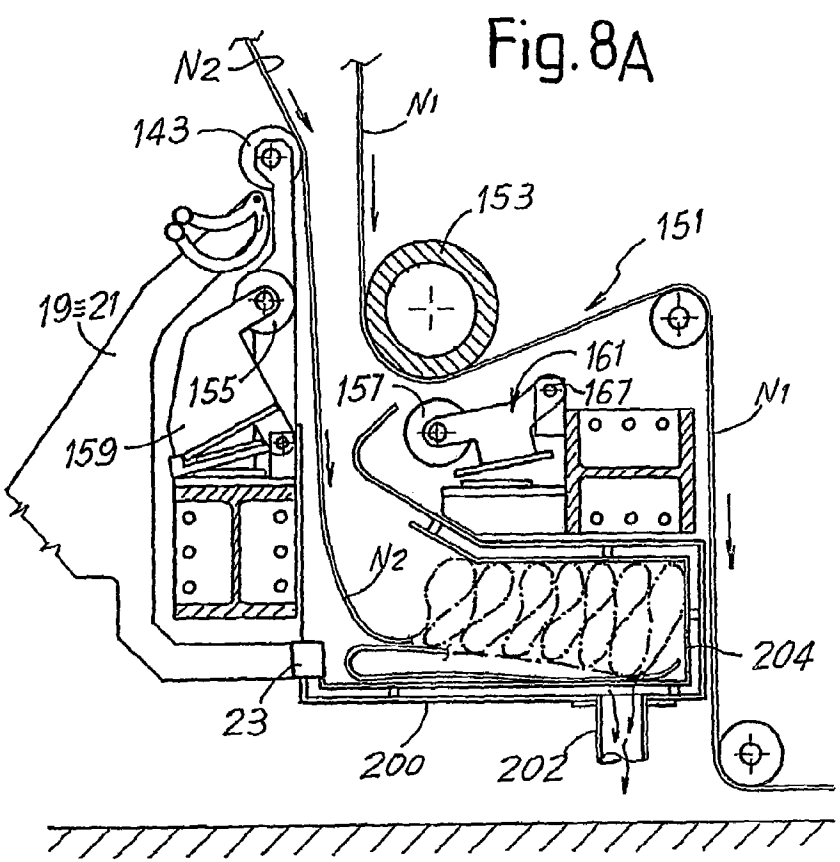

However, other configurations are also possible for realizing an accumulation member for the initial portion of web-like material coming from the new reel. An alternative configuration is illustrated in FIGS. 8A and 8B. The same or equivalent parts to those of the previous figures (in particular FIGS. 7A and 7B) are indicated with the same reference numbers. In this case, the roll 24 and the respective motor 26 are absent and the bar 23 is hollow and equipped with suction slots or holes that hold the head of the web-like material N2 in the preparation phase until the respective reel B2 is inserted inside the unwinding station 7.

During the acceleration phase of the reel B2, the initial portion of web-like material N2 is sucked inside a chamber 200 provided in the unwinding station 7. Thanks to a suction-pipe 202, the pressure inside the chamber 200 is slightly less than that of the atmosphere. Suction through the hollow bar 23 is interrupted. The web-like material that in the previous example of embodiment was wound around the roll 24 thus accumulates in the chamber 200. To avoid the web-like material that accumulates in the suction chamber 200 from obstructing the suction, a basket 204 is placed inside the chamber to hold the web-like material.

Once the splicing of the two web-like materials is completed, the suction inside the chamber 200 can be interrupted and all of the material that has accumulated is retrieved as shown in FIG. 8B in a similar manner to that previously described for the material temporarily wound around the roll 24.

With this arrangement, or with that which uses the roll 24, a temporary accumulation of web-like material is realized, which will subsequently be fed to the production line, and included on the roll containing the splice between the two layers. This roll is destined, in any case, to be recycled. In this way, the need to remove web-like material dross from the unwinding station 7 or the shuttle 9 by hand or with other systems is avoided.

Figure 9A:
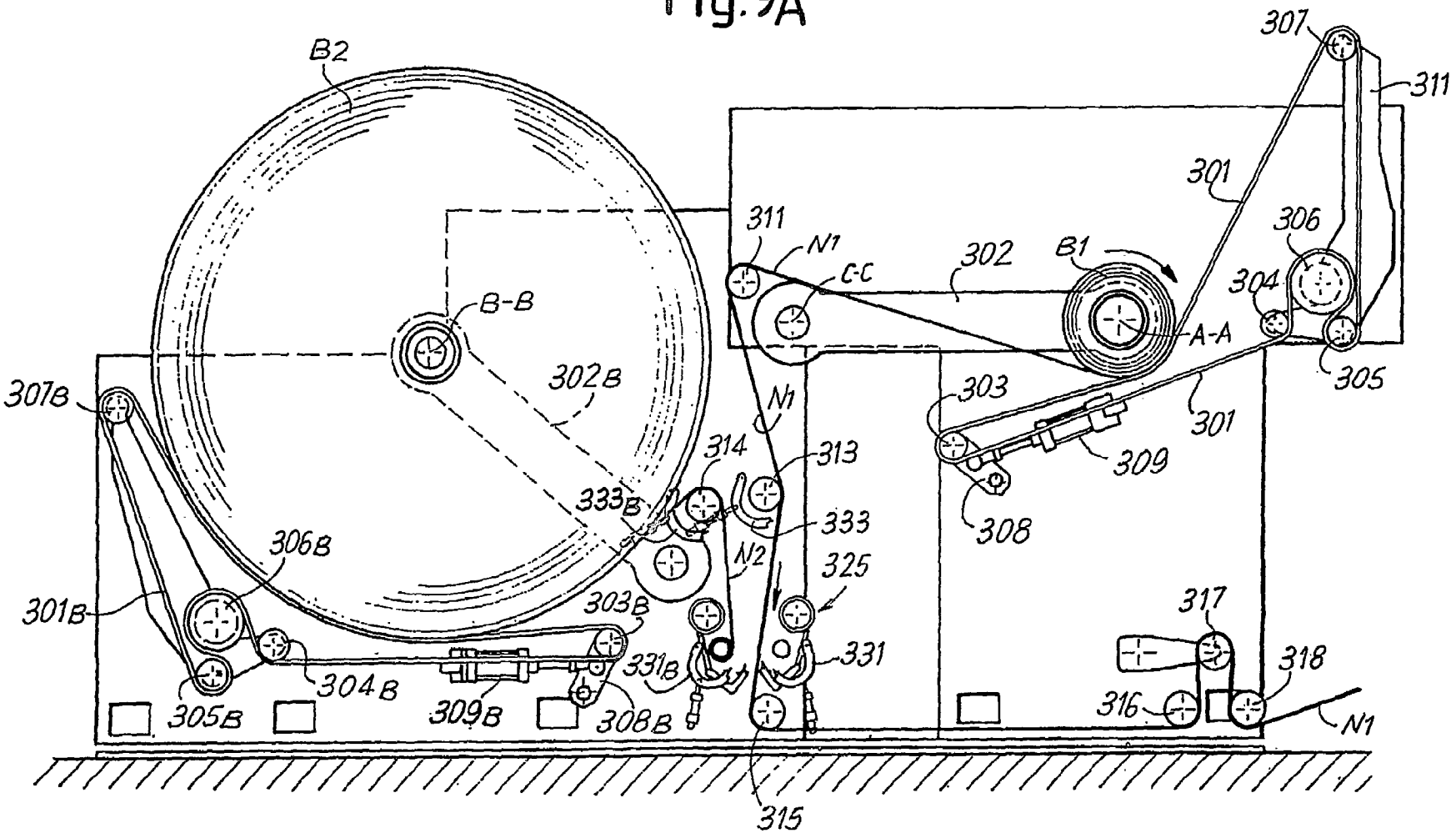
FIGS. 9A-9F show four different operating steps of an unwinder device according to the invention in a different embodiment.
Figure 9B:
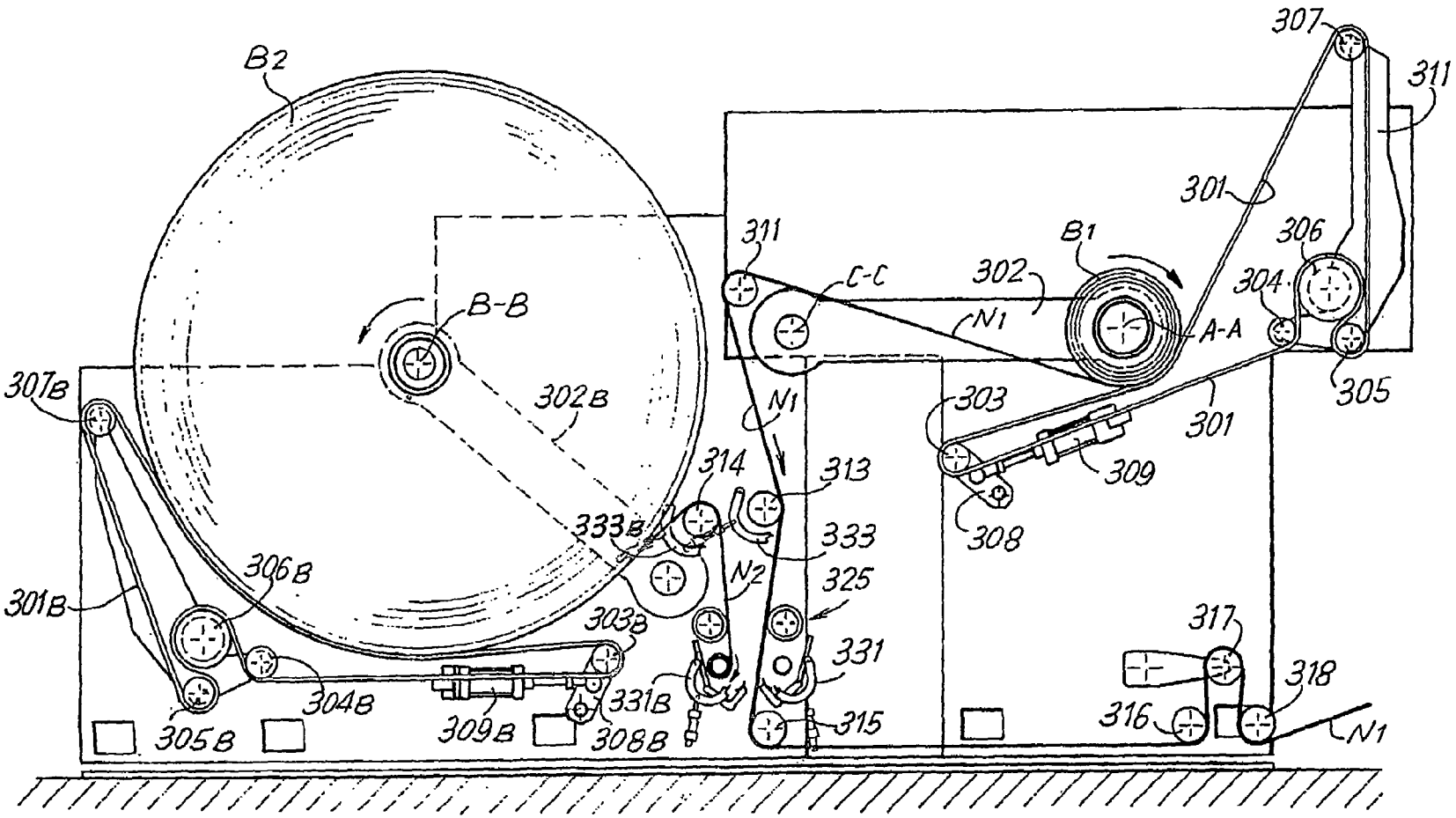
Figure 9C:
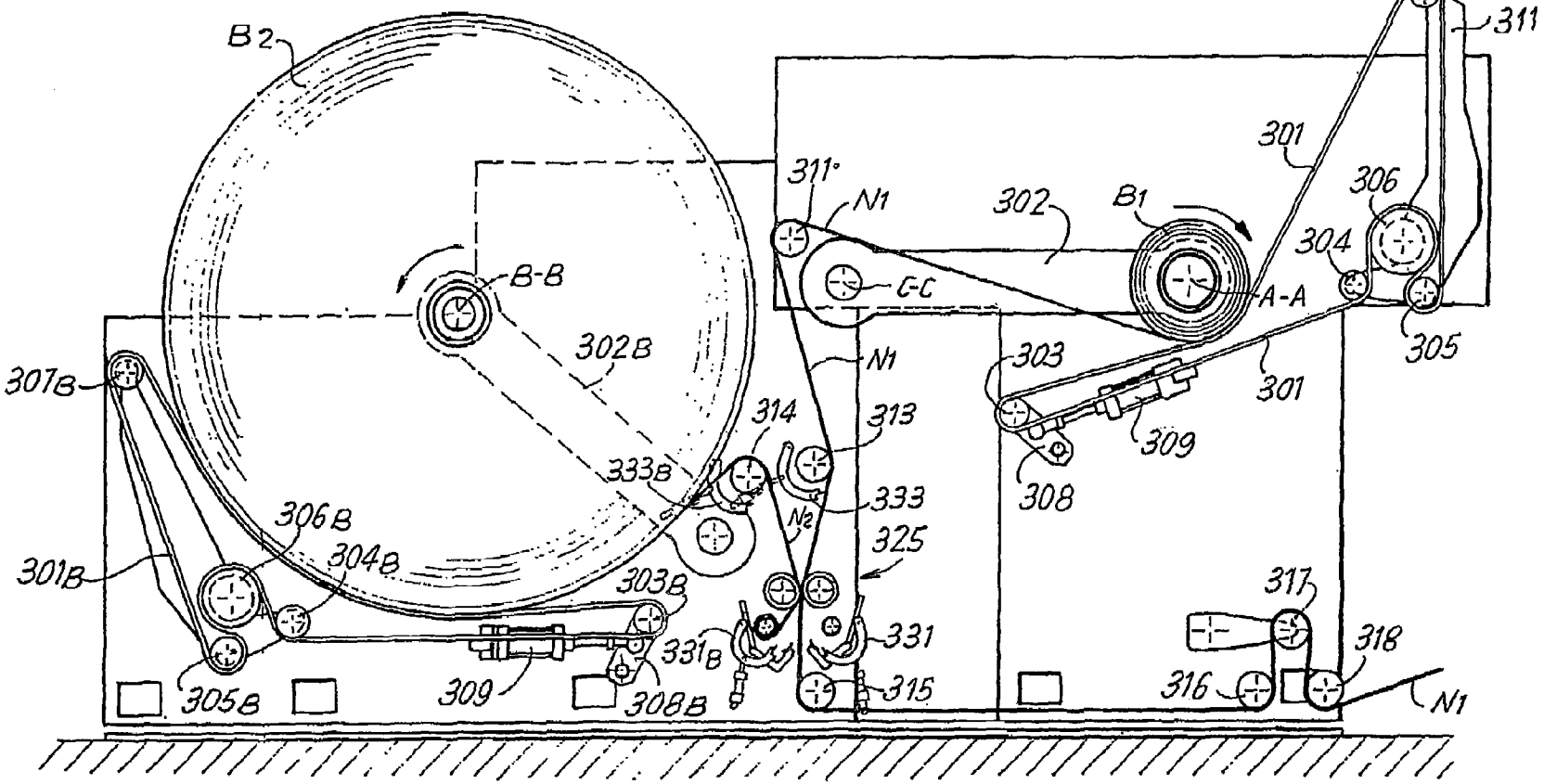
Figure 9D:
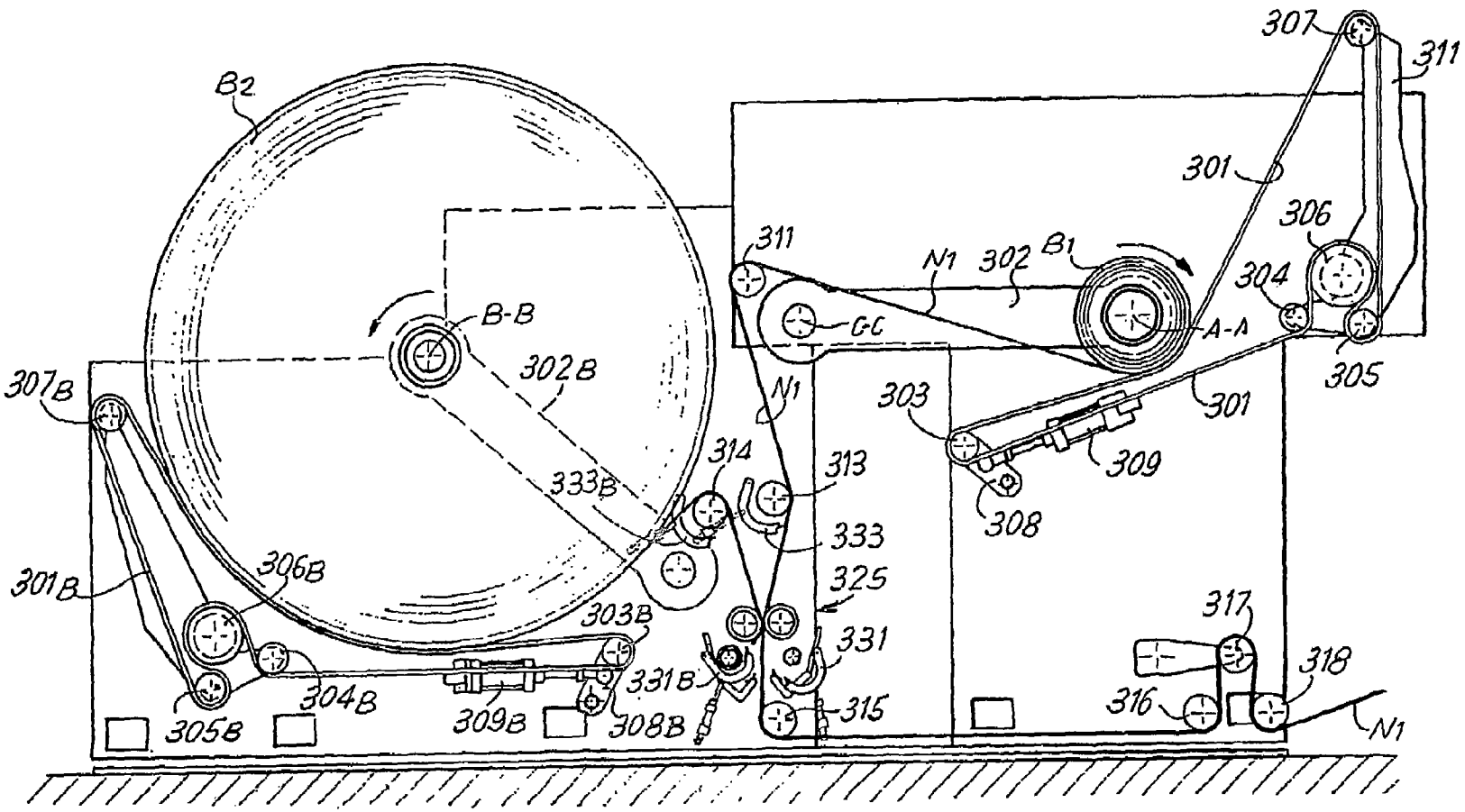
Figure 9E:
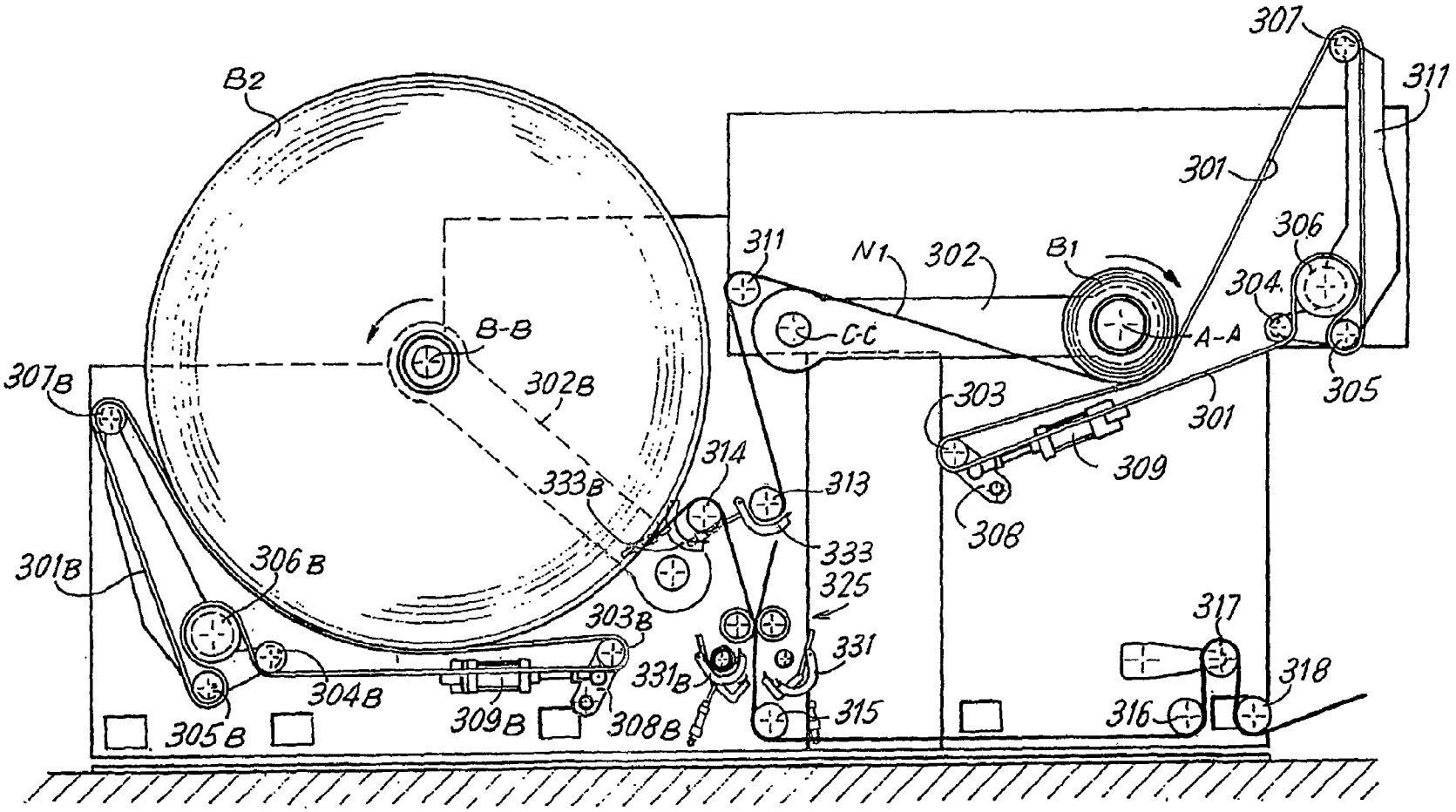
Figure 9F:
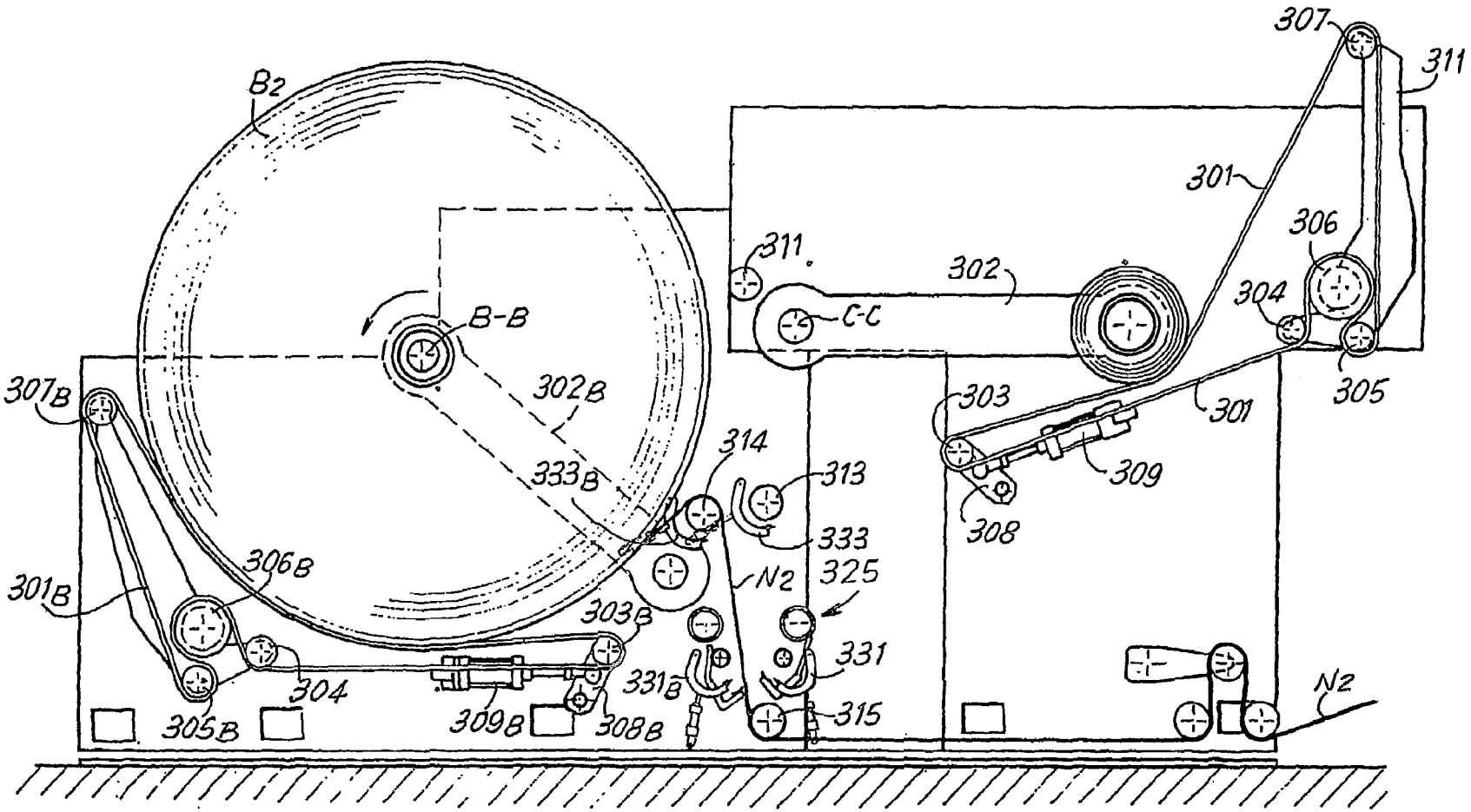
Figure 10:
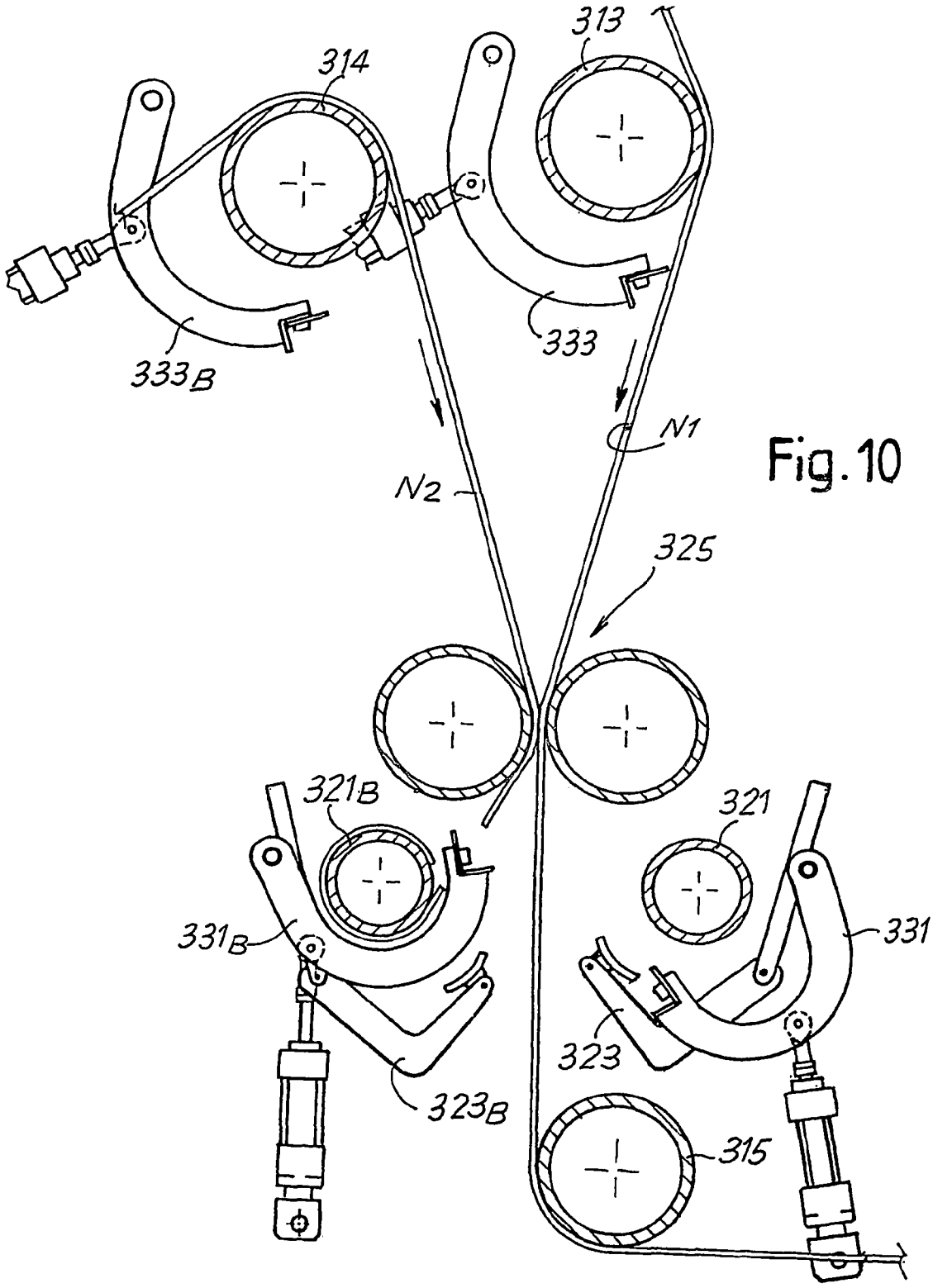
FIG. 10 shows an enlarged detail of the unwinder of FIGS. 9A-9F.

FIGS. 9A-9F show a simplified unwinder device embodying the invention in various steps of the splicing phase. FIG. 10 shows an enlargement of the splicing zone.

The unwinder is provided with two unwinding positions. Referring to FIG. 9A, in a first unwinding position a first almost exhausted reel B1 is arranged, from which a first web-like material N1 is fed towards a downstream converting or processing line (not shown). The reel B1 is kept into rotation by a surface unwinding member 301 in the form of endless belts entrained around rollers 303, 304, 305, 306, 307, roller 306 being driven into rotation by a motor (not shown). Roller 303 is supported by a pair of oscillating arms 308 acted upon by a cylinder-piston actuator 309, which keeps the belts 301 under tension while the diameter of reel B1 is reduced due to web feeding. The rollers 304, 305, 306, 307 are supported by an arm 311 connected to the fixed structure of the unwinder device. The axis A-A of the reel B1 is supported by arms 302 pivotally connected at C-C to the structure of the unwinder. The arrangement is such that the belts 301 are kept constantly under tension and pressed against the outer surface of reel B1, while its diameter decreases following web paying off, in order to keep the reel into rotation and feed the web-like material N1. The arms 302 are lowered step-wise as the diameter of reel B1 decreases, while between one lowering step and the next belt tension is ensured by cylinder-piston actuator 309.

The reel B1 is placed on the pivoting arms 302 by conventional means, not shown.

A second reel B2 of web-like material N2 has been placed in a second unwinding position, and is supported on axis B-B by pivoting arms 302B. Unwinding belts 301B entrained around rollers or pulleys 304B, 305B, 306B, 307B are provided for driving reel B2 into rotation. Similarly to arms 302, also arms 302B can be stepwise lowered while the reel diameter decreases. A cylinder-piston arrangement 309B connected to an oscillating arm 308B supporting roller 303B keeps the belts under tension and in contact with the outer periphery of reel B2.

In FIG. 9A the reel B2 is not rotating yet, while reel B1 is still delivering its web-like material N1. The latter is driven around guiding rollers 311-318 towards the downstream processing line (not shown). Reel B2 is in a waiting position, ready to replace reel B1 once the latter is empty. The front-end portion of the web-like material N2 is arranged around guiding roller 314 and its leading edge has been anchored to a core 321B engaged by tailstocks (not shown) which can drive it into rotation around its own axis. The leading edge of the web-like material N2 is attached to the core 321B e.g. by means of a strip of pressure-sensitive bi-adhesive tape applied along the edge of the web-like material. A pressure element 323B is used to press the edge of the web-like material N2 against the core 321B. Insertion of the leading edge of the web-like material N2 towards the core 321B is obtained in a manner known per se, e.g. by means of insertion belts.

A similar symmetrical arrangement 321, 323 is provided for anchoring the leading edge of web-like material N1 on core 321.

A ply-bonding unit 325 is arranged upstream of cores 321, 321B and is used to splice the two web-like materials N1, N2 as required.

Oscillating severing devices 331, 333 and 331B, 333B acted upon by respective cylinder-piston actuators are arranged between the cores 321, 321B and the ply-bonding unit 325 and between the latter and rollers 313, 314 respectively. The purpose of these devices will become clear from the following description of the splicing cycle.

Starting from the condition shown in FIG. 9A, the device operates as follows. The reel B1 is almost empty and must be replaced by fresh reel B2. The leading edge of reel B2 has been attached to core 321B.

Before splicing web-like material N1 and web-like material N2 together, the reel B2 is driven into rotation and accelerated until the peripheral speed thereof reaches the speed of the web-like material N1. In FIG. 9B both reels B1 and B2 are rotating. Reel B1 may be slowed down slightly or may still rotate at normal production speed. The web-like material paid-off by reel B2 during this acceleration phase is wound onto core 321B, which is kept into rotation and forms an accumulator member.

When the speeds of the two webs N1 and N2 is substantially the same (FIG. 9C), splicing is performed by the ply-bonding unit 325. The pressure applied on the two webs between the rollers forming the ply-bonding unit causes adhesion of the two web-like materials N1 and N2. The leading portion of web-like material N2, which has been wound onto the core 321B, is cut away by severing device 331B (FIG. 9D), while the tail edge of the web-like material N1 is separated by severing device 333 (FIG. 9E). Once the two severing operations have been performed, the reel B1 stops and the processing line downstream the unwinder is fed with web-like material N2 from reel B2 (FIG. 9F).

The core 321B on which the first portion of web-like material N2 has been accumulated is removed. This core can be made of cardboard. In such case it is recycled together with the web-like material N2 by returning them to the pulper. Alternatively, the cores 321, 321B can be made of plastic, metal or the like. In such case the web-like material wound thereon is removed and recycled, while the core is re-used.

Replacement of reel B2 once it is empty occurs in quite the same way as described above, by accumulating the leading portion of the web-like material N1 of a new reel B1 on core 321, splicing and cutting of the leading edge portion by means of the severing device 331 as well as cutting of the tail edge portion of web-like material N2 by means of the severing device 333B.

Figure 11:
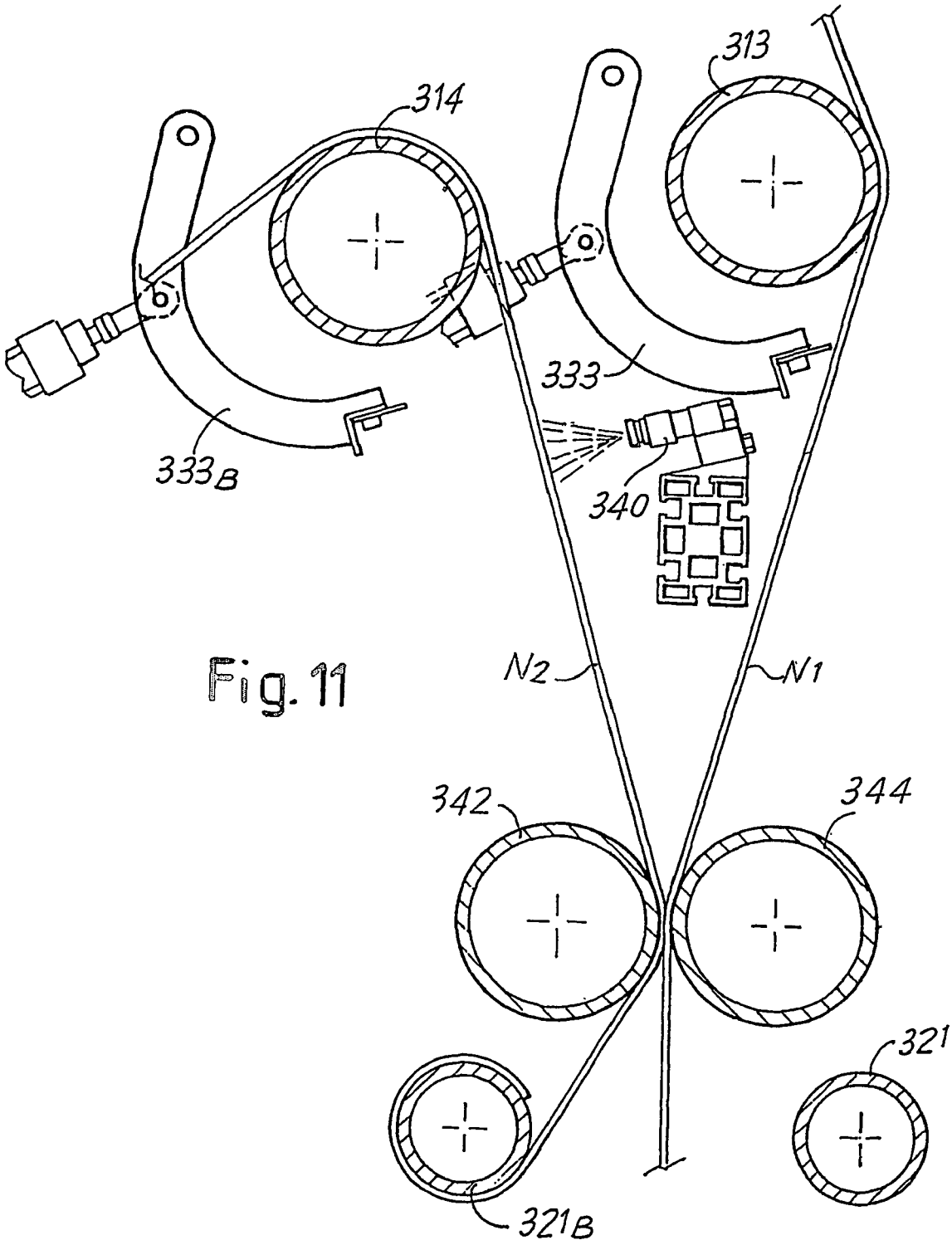
FIG. 11 shows an enlargement similar to FIG. 10, in a slightly different embodiment of the splicing means.

Splicing of the two web-like materials N1 and N2 can be performed differently than by ply-bonding. E.g., as shown in FIG. 11 (where the same numbers are used to indicate the same or equivalent parts as in FIGS. 9A-9F, 10), a set of transversely aligned spraying nozzles 340 is arranged across the width of the web-like material. When the two webs must be spliced together, the nozzles 340 spray an adhesive on web-like material N2 and the two web-like materials are pressed together by rollers 342, 344. A similar splicing device could be used also in the embodiments disclosed in FIGS. 1-8.

While the above description refers to cores 321, 321B which are removed from the machine upon severing the web-like material and the leading portion of the web-like material wound thereon is recycled, the possibility is not excluded that the direction of rotation of cores 321, 321B be reversed upon splicing, and that at least part of the web-like material accumulated thereon be returned and recovered downstream, as disclosed with respect to the previously disclosed embodiments.

It is understood that the drawings only show possible embodiments of the invention, which can vary in form and arrangement without however departing from the scope of the concept underlying the invention. Any reference numbers in the attached claims are provided only in order to facilitate the reading of the claims reference being made to the foregoing description and the enclosed drawings, and do not limit the scope of protection of the claims.

The invention claimed is:

1. An unwinder device for unwinding reels of web material comprising unwinding members for simultaneously unwinding a first reel and a second reel, a splicing device for splicing together a first web material coming from said first reel and a second web material coming from said second reel, said splicing device comprising two co-acting opposing splicing members, at least one accumulator member for accumulating said second web material supplied by said second reel before splicing to the first web material supplied by said first reel, wherein said accumulator member is placed, along a path of the second web material, downstream of said splicing device and downstream of a zone in which said splicing between said first web material and said second web material starts.

2. The unwinder device according to claim 1, wherein said accumulator member, said splicing device and said unwinding members are arranged and controlled such that while unwinding said first web material from said first reel and supplying said first web material to a production line, said second reel is put into rotation and starts to unwind said second web material; and said second web material is accumulated in an accumulation zone before said splicing; after said splicing said second web material is fed to said production line.

3. An unwinder device according to claim 1, wherein said splicing member and said unwinding members are controlled in a manner such that the splicing member splices together the first web material and the second web material when said first reel and said second reel rotate at substantially a common peripheral speed.

4. The unwinder device according to claim 1, wherein said accumulator member includes at least one roll to which a free leading edge of said second web material is anchored, the second web material winding itself around said roll when the second reel is made to rotate and before the second web material is spliced to the first web material.

5. The unwinder device according to claim 4, wherein said roll is motorized.

6. The unwinder device according to claim 4, wherein said roll is a suction roll for holding the free leading edge of the second web material.

7. The unwinder device according to claim 1, wherein said accumulator member is situated in a fixed position.

8. The unwinder device according to claim 1, wherein said splicing device is a ply-bonding device.

9. The unwinder device according to claim 8, wherein said splicing device includes two ply-bonding groups.

10. The unwinder device according to claim 1, wherein said splicing device has two splicing zones arranged in series along the path of the second web material.

11. The unwinder device according to claim 1 further comprising severing devices for interrupting spliced web material coming from a reel that is running out after splicing with the first web material and the second web material coming from a new full reel.

12. The unwinder device according to claim 1, wherein said at least one accumulator member is constructed and arranged to retain said second web material accumulated and remaining thereon after said splicing.

13. The unwinder device according to claim 12 further comprising severing devices for severing the second web material accumulated on said accumulator member.

14. An unwinder device for unwinding reels of web material comprising unwinding members for simultaneously unwinding a first reel and a second reel, a splicing device for splicing together a first web material coming from said first reel and a second web material coming from said second reel, at least one accumulator member for accumulating said second web material supplied by said second reel before splicing to the first web material supplied by said first reel, wherein said accumulator member is placed, along a path of the second web material, downstream of a zone in which said splicing between said first web material and said second web material starts, and wherein said accumulator member is reversible and passes back accumulated web material, after the first web material and the second web material are spliced together.

15. An unwinder device for unwinding reels of web material comprising unwinding members for simultaneously unwinding a first reel and a second reel, a splicing device for splicing together a first web material coming from said first reel and a second web material coming from said second reel, at least one accumulator member for accumulating said second web material supplied by said second reel before splicing to the first web material supplied by said first reel, wherein said accumulator member is placed, along a path of the second web material, downstream of a zone in which said splicing between said first web material and said second web material starts, and further comprising a shuttle mobile between at least one loading station and an unwinding station for transferring reels from said loading station to said unwinding station, and wherein said accumulator member is carried by said shuttle.

16. The unwinder device according to claim 15, wherein said shuttle includes retaining devices for a free leading edge of the first web material and the second web material wound on the first reel and the second reel respectively carried by said shuttle.

17. The unwinder device according to claim 16, wherein said retaining devices are associated with a motorized roll.

18. A method for unwinding reels of web material comprising unwinding a first web material from a first reel and supplying said first web material to a production line, making a second reel rotate and starting to unwind a second web material from said second reel;

accumulating said second web material in an accumulation zone before splicing, splicing by two opposing and co-acting splicing members said second web material to said first web material and supplying said second web material to said production line, wherein said second web material is accumulated in said accumulation zone, before the splicing, by an accumulator member arranged downstream of said splicing members.

19. The method according to claim 18, wherein said first reel and said second reel are made to rotate at substantially a common peripheral speed before splicing said first web material to said second web material.

20. The method according to claim 18, wherein said second web material is temporarily wound around a roll.

21. The method according to claim 18, wherein said accumulation zone is situated downstream, along a path of the second web material, with respect to a zone where the splicing between the first web material and the second web material starts.

22. The method according to claim 18, wherein said first web material and said second web material are spliced together by ply-bonding.

23. The method according to claim 18, wherein said first web material and said second web material are spliced together via two distinct splicing groups arranged in series along a feed path.

24. The method according to claim 23, wherein said accumulation zone is arranged between said first splicing group and said second splicing group.

25. The method according to claim 18, wherein the second web material accumulated in said accumulation zone is separated from the first web material coming from a respective reel and recycled.

26. A method for unwinding reels of web material comprising unwinding a first web material from a first reel and supplying said first web material to a production line, making a second reel rotate and starting to unwind a second web material from said second reel;

accumulating said second web material in an accumulation zone before splicing, splicing said second web material to said first web material and supplying said second web material to said production line, wherein said second web material is accumulated in said accumulation zone before splicing, said accumulation zone being arranged downstream of a zone in which said splicing starts, and wherein after the splicing of said second web material to said first web material, the spliced web material accumulated in said accumulation zone is retrieved and fed to said production line.

27. A method for unwinding reels of web material comprising unwinding a first web material from a first reel and supplying said first web material to a production line, making a second reel rotate and starting to unwind a second web material from said second reel;

accumulating said second web material in an accumulation zone before splicing, splicing said second web material to said first web material and supplying said second web material to said production line, wherein said second web material is accumulated in said accumulation zone before splicing, said accumulation zone being arranged downstream of a zone in which said splicing starts, wherein said second web material is temporarily wound around a roll, and wherein said roll is made to rotate in a winding sense for temporarily accumulating said second web material and, after the splicing of the first web material and the second web material, direction of rotation of said roll is inverted.

28. A method for unwinding reels of web material comprising unwinding a first web material from a first reel and supplying said first web material to a production line, making a second reel rotate and starting to unwind a second web material from said second reel;

accumulating said second web material in an accumulation zone before splicing, splicing said second web material to said first web material and supplying said second web material to said production line, wherein said second web material is accumulated in said accumulation zone before splicing, said accumulation zone being arranged downstream of a zone in which said splicing starts, wherein said second web material is temporarily wound around a roll, and wherein a portion of the second web material temporarily accumulated in said zone is made to adhere to the first web-like material when said second web material is retrieved.

29. An unwinder device for unwinding reels of web material comprising unwinding members for simultaneously unwinding a first reel and a second reel, a splicing device for splicing together a first web material coming from said first reel and a second web material coming from said second reel, at least one accumulator member for accumulating said second web material supplied by said second reel before splicing to the first web material supplied by said first reel, wherein said accumulator member is placed, along a path of the second web material, downstream of a zone in which said splicing between said first web material and said second web material starts, and wherein said accumulator member is constructed and arranged to retain accumulated web after said splicing.

30. A method for unwinding reels of web material comprising unwinding a first web material from a first reel and supplying said first web material to a production line, making a second reel rotate and starting to unwind a second web material from said second reel;

accumulating said second web material in an accumulation zone before splicing, splicing said second web material to said first web material and supplying said second web material to said production line, wherein said second web material is accumulated in said accumulation zone before splicing, said accumulation zone being arranged downstream of a zone in which said splicing starts, and wherein accumulated web material is retained, after said splicing, in said accumulation zone.

* * * * *